US009681697B2

(12) United States Patent
Ikeda

(10) Patent No.: US 9,681,697 B2
(45) Date of Patent: Jun. 20, 2017

(54) HELMET

(71) Applicant: SHOEI CO., LTD., Tokyo (JP)

(72) Inventor: Yoshiyuki Ikeda, Tokyo (JP)

(73) Assignee: SHOEI CO., LTD., Tokyo (JP)

( * ) Notice: Subject to any disclaimer, the term of this patent is extended or adjusted under 35 U.S.C. 154(b) by 58 days.

(21) Appl. No.: 14/818,311

(22) Filed: Aug. 5, 2015

(65) Prior Publication Data

US 2016/0037853 A1 Feb. 11, 2016

(30) Foreign Application Priority Data

Aug. 5, 2014 (JP) ..... 2014-159788

(51) Int. Cl.

| | |
|---|---|
| ***A42B 1/06*** | (2006.01) |
| ***A42B 3/12*** | (2006.01) |
| ***A42B 3/32*** | (2006.01) |
| ***A42B 3/14*** | (2006.01) |

(52) U.S. Cl.

CPC ..... *A42B 3/127* (2013.01); *A42B 3/142* (2013.01); *A42B 3/322* (2013.01)

(58) Field of Classification Search

CPC ..... A42B 3/322; A42B 3/00; A42B 3/127; A42B 3/0473; A63B 71/10

USPC ..... 2/410, 411, 414, 425, 415, 424

See application file for complete search history.

(56) References Cited

U.S. PATENT DOCUMENTS

| | | | | |
|---|---|---|---|---|
| 6,701,535 | B2 * | 3/2004 | Dobbie | A42B 3/085 2/421 |
| 7,854,023 | B2 * | 12/2010 | Ando | A42B 3/127 2/414 |
| 8,549,671 | B2 * | 10/2013 | Sackett | A42B 3/328 2/414 |

FOREIGN PATENT DOCUMENTS

| | | |
|---|---|---|
| EP | 2338365 | 6/2011 |
| EP | 2484239 | 8/2012 |
| JP | 2001-295129 | 10/2001 |
| WO | 99/20133 | 4/1999 |
| WO | 2012/037927 | 3/2012 |
| WO | 2013/071916 | 5/2013 |
| WO | 2013/102834 | 7/2013 |

OTHER PUBLICATIONS

"The Extended European Search Report of European Counterpart Application", issued on Jan. 12, 2016, pp. 1-4.

* cited by examiner

*Primary Examiner* — Tejash Patel

(74) *Attorney, Agent, or Firm* — Jianq Chyun IP Office

(57) ABSTRACT

A helmet includes the first pad in contact with an occipital region of a rider, and each of the second pads in contact with the cheeks of the rider. Since the first pad moves from the first occipital region-contact position to the second occipital region-contact position as well as the second pad moves from the first cheek-contact position to the second cheek-contact position, the helmet is moved relative to the rider's head by a predetermined distance.

17 Claims, 23 Drawing Sheets

HELMET

CROSS-REFERENCE TO RELATED APPLICATION

This application claims the priority benefit of Japan application serial no. 2014-159788, filed on Aug. 5, 2014. The entirety of the above-mentioned patent application is hereby incorporated by reference herein and made a part of this specification.

BACKGROUND OF THE INVENTION

Field of the Invention

The present invention relates to a helmet.

Related Art

The invention relates to a helmet that is worn by a motorcycle rider.

A motorcycle rider is required to wear a helmet in terms of the protection of a head, particularly, a frontal region in case of an accident. Such a helmet has been evolving day by day in terms of safety not so as to cause the worst result even if an accident occurs, particularly, even if a rider strikes hard on his head.

Particularly, the field of view on the front upper side of a full-face type helmet is slightly sacrificed in terms of the protection of a frontal region. Further, with the faster traveling by a motorcycle, the more the rider leans forward. Accordingly, while the motorcycle travels at a high speed, the rider tends to be difficult to see the front upper side of the full-face type helmet.

Riders competing in Grand Prix motorcycle racing, which is one of the motorsports for motorcycles and is the top class category of a motorcycle road race, also wear full-face type helmets, which are developed mainly for a race, to protect their heads at the time of a crash. Further, as illustrated in FIG. 23, a rider must extremely look up and watch forward to try to obtain information about the next course when he tilts significantly his riding posture and takes a low posture for cornering and passing through a sharp curve. FIG. 23 is a diagram illustrating a state in which a rider competing in a road race tries to obtain information about the next course when he tilts significantly his riding posture and takes a low posture for cornering and passing through a sharp curve. In this case, since it is difficult to see the front upper side of the full-face type helmet, the fields of view of the riders are obstructed.

JP 2001-295129 A, WO 2012/037927 A, and WO 2013/071916 A disclose helmets, which easily absorb a rotating force generated due to an impact by allowing an outer liner to easily slide on an inner liner so as to increase the flexibility of a rotation direction, in order to effectively absorb a rotating force, one of the impact forces act on the helmet, of which acceleration is loaded in a direction along the outer surface of the helmet shell. Further, EP 2484239 A discloses a helmet of which the custom-made options is increased based on the head characteristics of a rider and the usage purpose of a helmet by changing the combination of the thicknesses, heights, and materials of the first and the second layers of an inner pads.

As described above, in order to ensure the field of view on the front upper side of the full-face type helmet, a general rider temporarily raises his body with one hand riding as necessary or, intentionally shifts his helmet slightly backward. However, since there is only one position at which the helmet fits the rider' head, the helmet does not fit the head when a rider shifts the helmet on his head. For this reason, it is afraid that a serious accident may occur at the worst since a protective function of the helmet does not act sufficiently.

Further, the motorsport riders worn the full-face type helmet also intentionally shift the helmet slightly backward when he tilts significantly his riding posture and takes a low posture for cornering and passing through a sharp curve in order to be capable of easily obtaining information about the next course. Since the helmets also do not fit their heads in this case, it is afraid that the fatal accidents may occur at the worst at the crashes or the like in the race in which the traveling speed is incomparably higher than that on a public road.

Furthermore, in each of the helmets disclosed in JP 2001-295129 A, WO 2012/037927 A, and WO 2013/071916 A, a mechanism, which allows the outer and the inner liners provided in the helmet to easily rotate relative to each other, has been provided for the purpose of easily absorbing the impact force loaded to the helmets, instead of ensuring of the field of view on the front upper side of the full-face type helmet when a rider wears the full-face type helmet. In addition, the helmet disclosed in EP 2484239 A intends to obtain a comfortable fit by changing the combination of the thicknesses, heights, and materials of first and second layers of the inner pads. Accordingly, these disclosed helmets have not solved yet a problem that the sufficient field of view on the front upper side cannot be assured when a rider wears the helmet ordinarily and then lean on a motorcycle.

SUMMARY OF THE INVENTION

One or more embodiments of the present invention provide a helmet that fits a rider's head and allows the field of view on the front upper side of the helmet to be easily ensured even when the rider extremely leans forward.

One or more embodiments of the present invention include a first pad that comes into contact with an occipital region of a rider and the second pads that comes into contact with the rider's cheeks. The first pad is movably provided so as to come into contact with the occipital region on at least the first and the second occipital region-contact positions. The second pads are provided so as to be movable to the second cheek-contact position from the first cheek-contact position coming into contact with the both cheeks when the first pad moves to the second occipital region-contact position from the first occipital region-contact position. When a first state, in which the first pad is located at the first occipital region-contact position and each second pad is located at the first cheek-contact position, is shifted to a second state, in which the first pad moves to the second occipital region-contact position and each second pad moves to the second cheek-contact position, the helmet moves relative to the rider's head by a predetermined distance.

One aspect of the present invention, it is possible to obtain a helmet that fits the rider's head and allows the field of view on the front upper side of the helmet to be easily ensured even when the rider extremely leans forward.

DESCRIPTION OF THE EMBODIMENTS

One or more embodiments of the present invention is to improve the field of view on the front upper side of the helmet while it keeps a helmet to fit the rider's head when the rider wears the helmet and then rides a motorcycle so as to leans forward. That is, one or more embodiments of the present invention is to allows the helmet to fit the rider's head and is to easily ensure the front upper sight of the rider, when the rider rides a motorcycle so as to leans forward, by moving the interior pads of the helmet for a little distance from an original fixation position and, as a result, moving the helmet relative to the rider's head by a predetermined distance.

Figure 1:
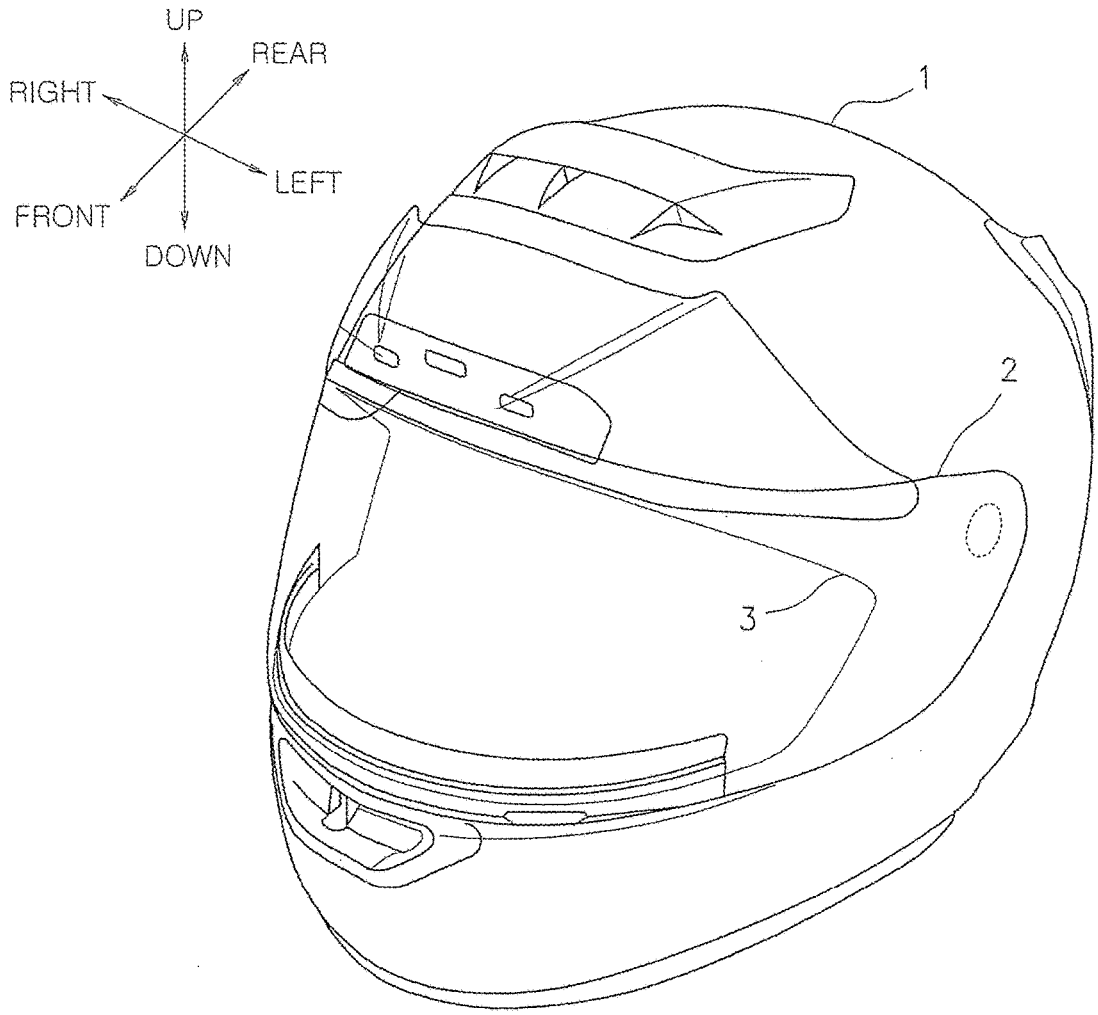
FIG. 1 is a perspective view of the entire helmet according to an embodiment.
Figure 2:
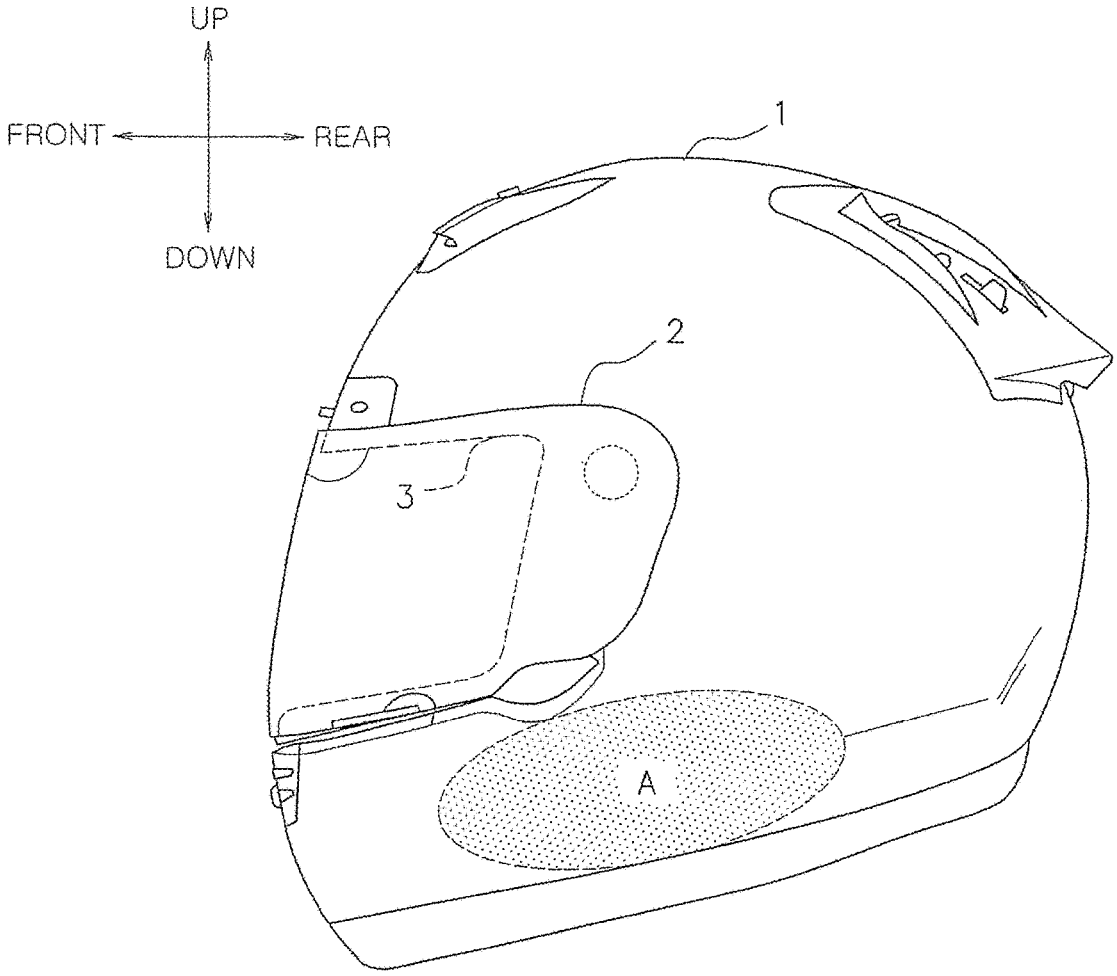
FIG. 2 is a side view of the entire helmet according to this embodiment.

First, the shape of the entire helmet according to an embodiment of the invention will be described. FIG. 1 is a perspective view of the entire helmet according to this embodiment, and FIG. 2 is a side view of the entire helmet according to this embodiment. Further, FIG. 3 is a rear view of the helmet according to this embodiment.

Figure 3:
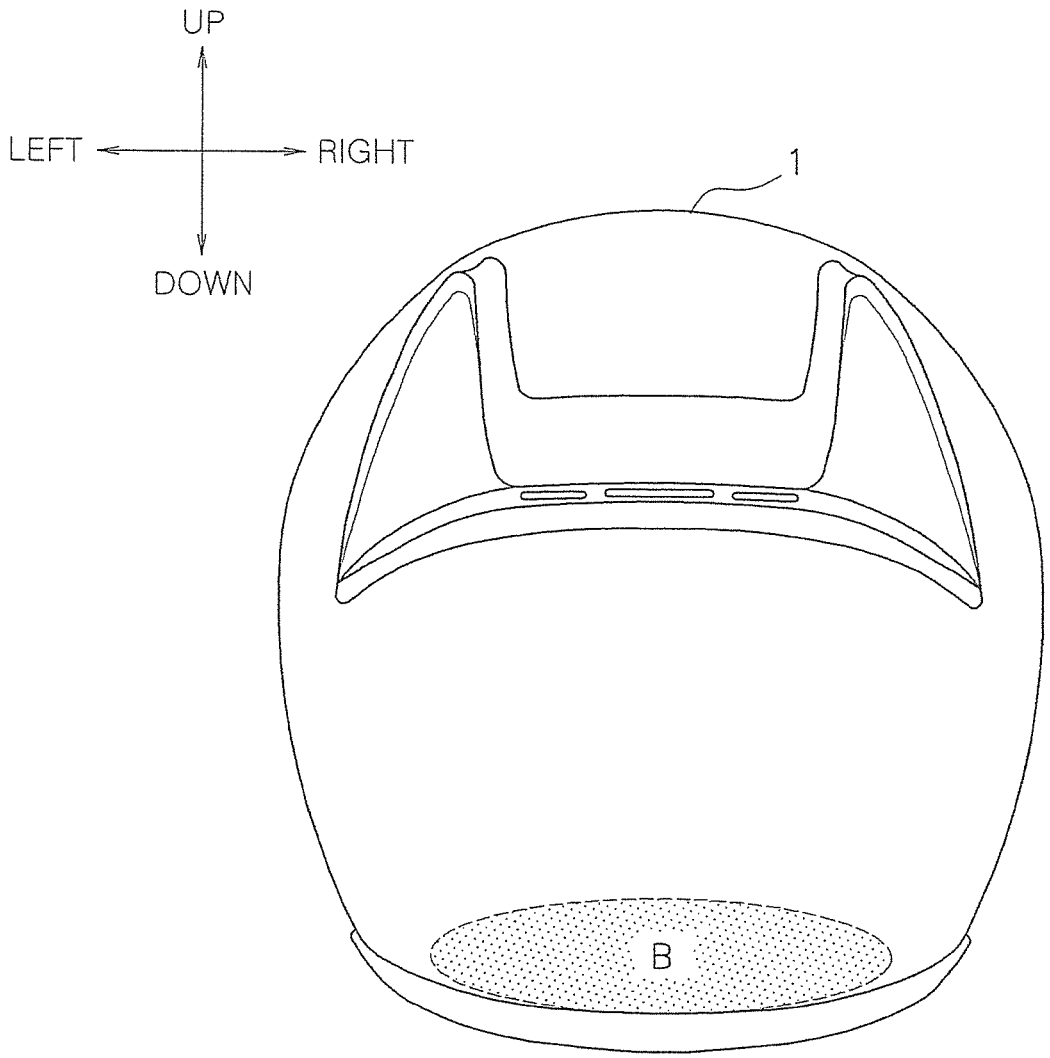
FIG. 3 is a rear view of the helmet according to this embodiment.

In FIGS. 1 to 3, a shield 2 covering a front window 3 is detachably mounted on a helmet for a motorcycle rider. The shield 2 is made of a synthetic resin that is translucent and hard (for example, polycarbonate). Further, as described below, the interior pads are mounted on an inner portion of a helmet 1 that comes into contact with heads 4N and 4F of a rider in FIGS. 16 and 17. Furthermore, the helmet according to the embodiment of the invention is characterized in that both members, which fix both cheek pads at each of the first and the second positions which are movable each other, are provided in the interior of an area A illustrated in FIG. 2 and a member, which fixes a neck pad at each of the first and the second positions which are movable each other, is provided in the interior of an area B illustrated in FIG. 3, so that a center pad joined to the neck pad moves for a little distance to a second state from a first state that is an original fixing state. The cheek pads and the neck pad will be briefly described here. The cheek pads mean the interior pads that are disposed inside the helmet 1 so as to correspond to cheeks, and the neck pad means an interior pad that corresponds to a portion between an occipital region and the neck. Both cheek pads and the neck pad support covering the entire head. Meanwhile, in the drawings, a front arrow indicates a traveling direction of a motorcycle, a rear arrow indicates a direction opposite to the traveling direction, and left and right arrows indicate leftward and rightward directions, which are perpendicular to the traveling direction, with respect to the traveling direction, respectively.

Figure 4:
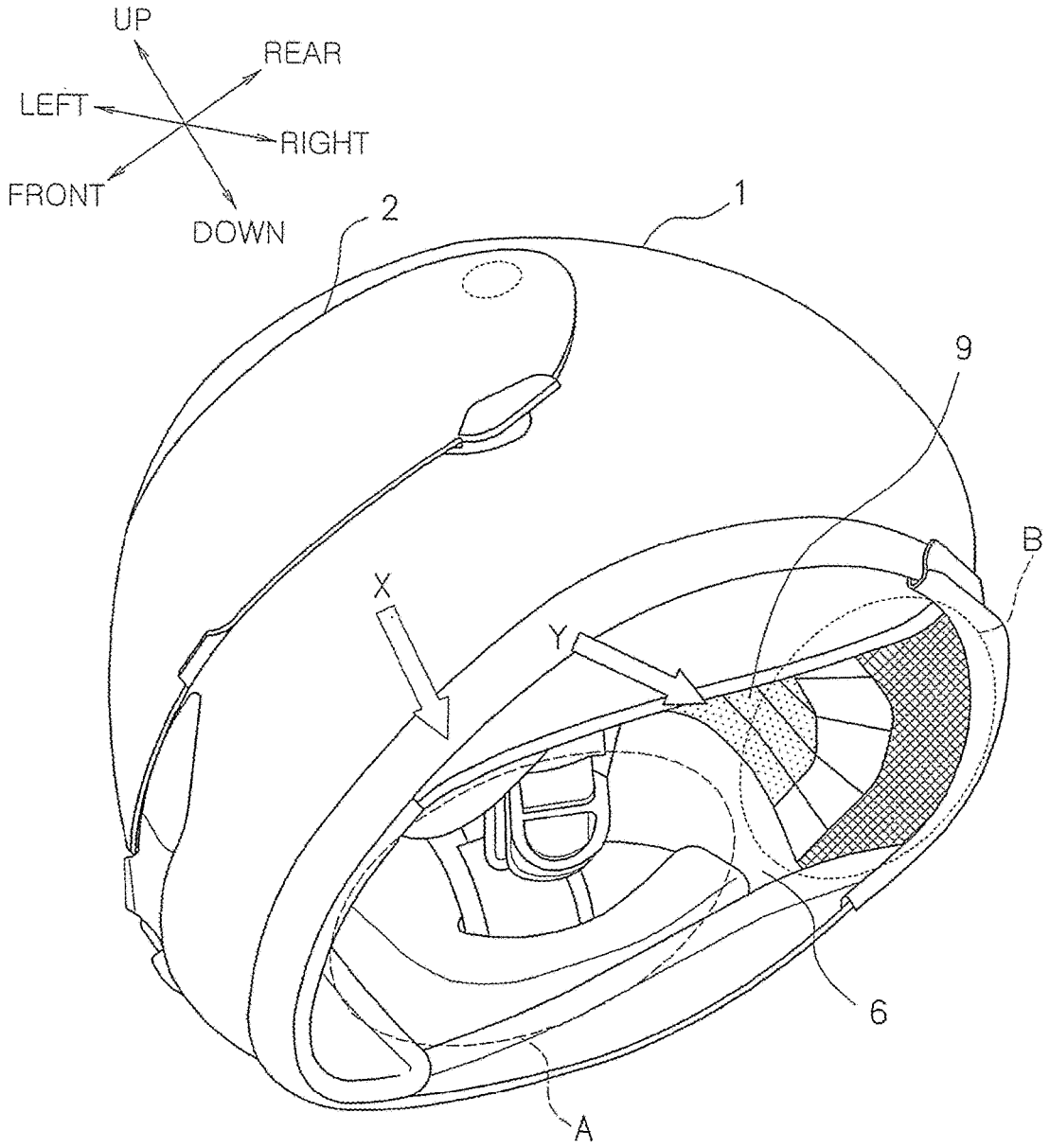
FIG. 4 is a diagram illustrating the location of a second pad (hereinafter, referred to as "cheek pads") and the location of a first pad (hereinafter, referred to as a "neck pad") of the helmet according to this embodiment.

Next, the positions of both cheek pads and the position of a neck pad of the helmet according to this embodiment will be described. FIG. 4 is a diagram illustrating the positions of both cheek pads and the position of a neck pad of the helmet according to this embodiment. As illustrated in FIG. 4, other pads and the neck pad of the helmet 1 are integrated with each other to form a center pad 9. Meanwhile, the configuration of the center pad 9 can be adopted the optional shapes and structures, for example a large pad covering a portion between the forehead of a rider and an upper portion of the neck via a parietal region, a small pad covering only the occipital region of a rider, and one separable pad into the pads covering the frontal region, the parietal region, the left and right temporal regions, and the occipital region, respectively. That is, even though having any shape and structure, all pads joined to the neck pad are called the center pad.

In FIG. 4, either mechanism, which fixes both cheek pads at each of the first and the second positions which are movable each other, is provided in an area A seen in the direction of an arrow X, and a mechanism, which fixes the position of the neck pad at each of the first and the second positions which are movable each other, is provided in an area B seen in the direction of an arrow Y. Hereinafter, the mechanism that fixes the both cheek pads at each of the first and the second positions and the mechanism that fixes the neck pad at each of the first and second positions will be described in detail.

Figure 5:
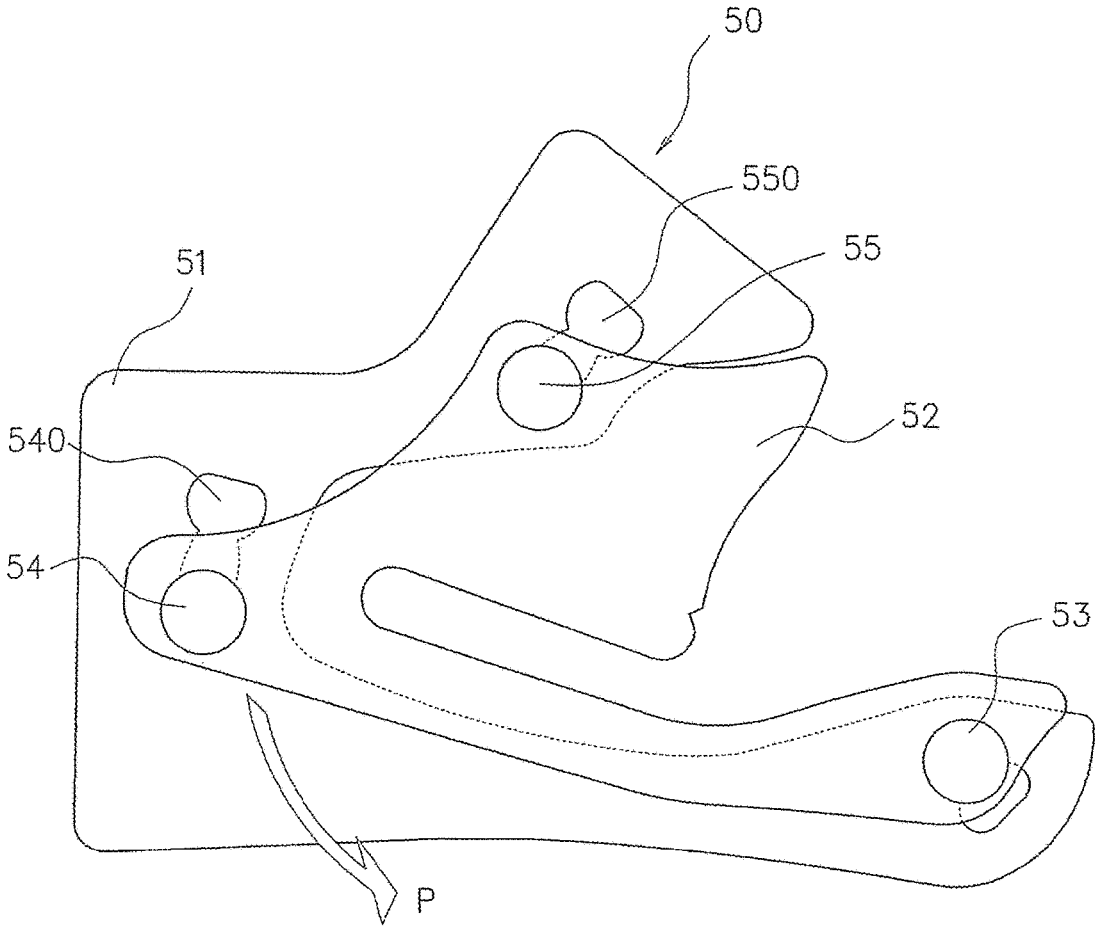
FIG. 5 is a diagram illustrating the state of a cheek pad set at the first cheek-contact position in a mechanism which fixes the cheek pads at the first and the second cheek-contact positions, which are movable positions each other, on both sides of the helmet according to this embodiment.
Figure 6:
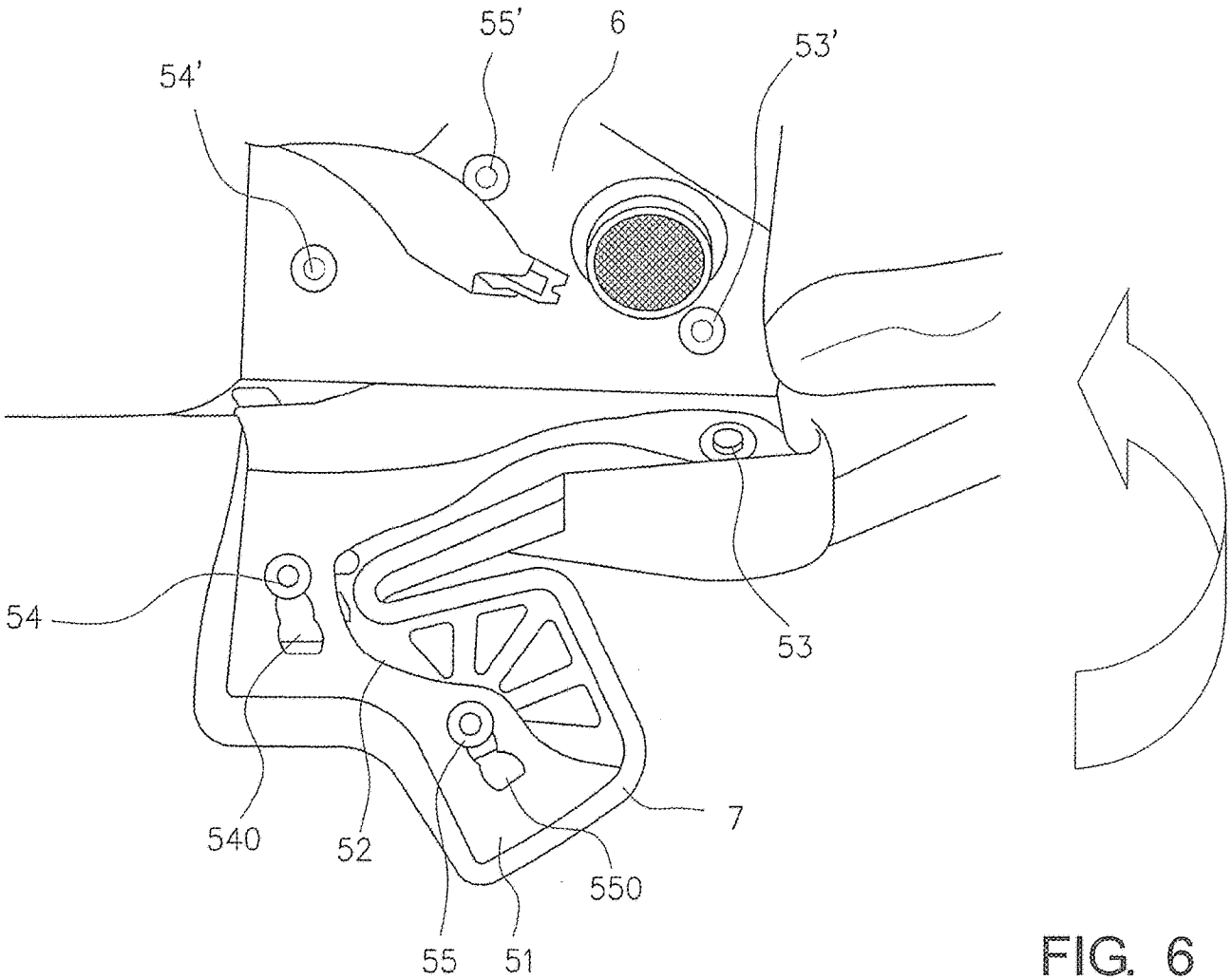
FIG. 6 is a diagram illustrating a state of removing from the helmet a cheek pad, which is set at the first cheek-contact position in the installed mechanism which fixes the cheek pads at the first and the second cheek-contact positions, which are movable positions each other, on both side of the helmet according to this embodiment.

First, a specific example of the mechanism will be described, which fixes the cheek pads at each of the first and the second cheek-contact positions, which are movable each other, on both inner side of the helmet. FIG. 5 is a diagram illustrating the state of the cheek pads at the first cheek-contact position in the mechanism, which fixes the cheek pads on both sides of the helmet according to this embodiment at each of the first and second cheek-contact positions which are movable each other. FIG. 6 is a diagram illustrating a state of removing from the helmet a cheek pad, which is set at the first cheek-contact position in the installed mechanism, which fixes the cheek pads at the first and the second cheek-contact positions, which are movable positions each other, on both side of the helmet according to this embodiment.

Figure 7:
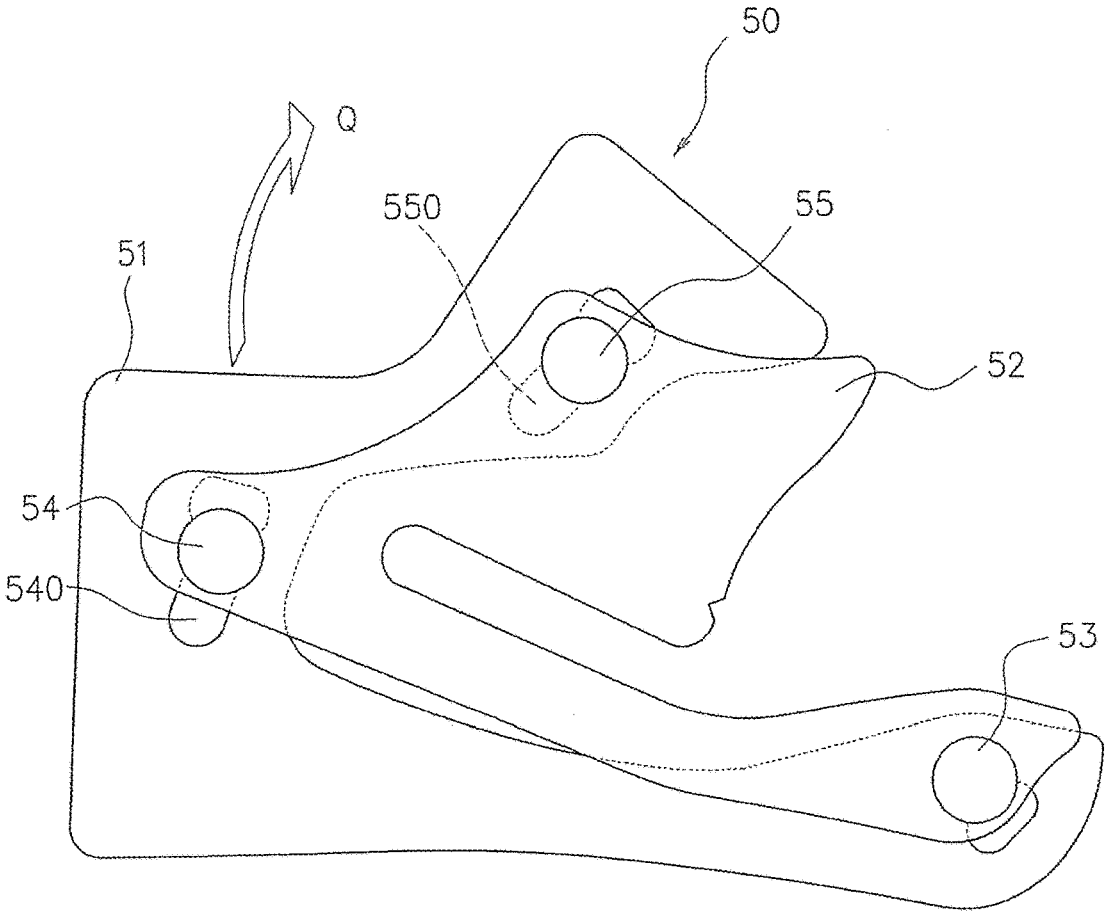
FIG. 7 is a diagram illustrating the state of a cheek pad set at the second cheek-contact position in a mechanism which fixes the cheek pads at the first and the second cheek-contact positions, which are movable positions each other, on both sides of the helmet according to this embodiment.
Figure 8:
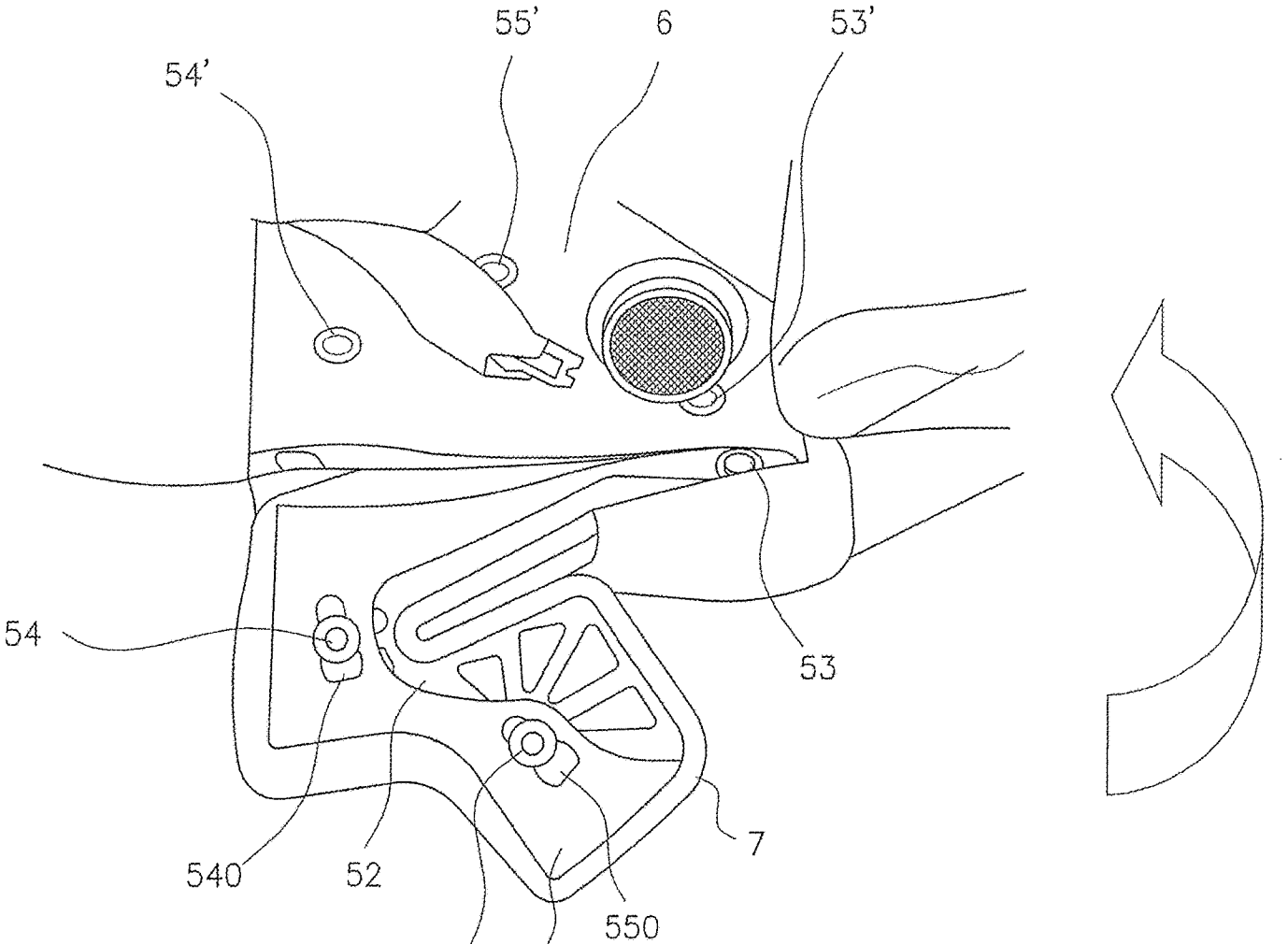
FIG. 8 is a diagram illustrating a state of removing from the helmet a cheek pad, which is set at the first cheek-contact position in the installed mechanism which fixes the cheek pads at the first and the second cheek-contact positions, which are movable positions each other, on both sides of the helmet according to this embodiment.

Further, FIG. 7 is also a diagram illustrating the state of a cheek pad set at the second cheek-contact position in a mechanism which fixes the cheek pads at the first and the second cheek-contact positions, which are movable positions each other, on both sides of the helmet according to this embodiment. FIG. 8 is a diagram illustrating a state of removing from the helmet a cheek pad, which is set at the first cheek-contact position in the installed mechanism, which fixes the cheek pads at the first and the second cheek-contact positions, which are movable positions each other, on both sides of the helmet according to this embodiment.

As illustrated in FIGS. 5 to 8, the mechanism 50, which fixes the cheek pads at each of the first and the second cheek-contact positions, which are movable positions each other, on both the inner sides of the helmet according to this embodiment, is composed of a first member 51 and a second member 52 as a specific example thereof and both the members are engaged with each other by members 53, 54, and 55. As illustrated in FIGS. 5 and 7, the second member 52, which is engaged with the first member 51 by the members 53, 54, and 55, is composed so that the position of the second member 52 relative to the first member 51 changes between the first and the second cheek-contact position, which are movable positions each other, by shifting the member 54 along the groove 540 and the member 55 along the groove 550 while the member 53 serves as a fulcrum. Here, as shown in FIGS. 6 and 8 in which the first member 51 is integrally joined to the cheek pad 7, the cheek pad 7 can be mounted in a direction of an arrow as illustrated in FIGS. 6 and 8, and connected to the helmet 1 through the second member 52 and the first member 51, by fixing the member 53 with the member 53', the member 54 with the member 54', and the member 55 with the member 55', respectively.

Meanwhile, a mechanism in which a so-called hook moves in a groove is described in the embodiment as a specific example of the mechanism 50 that fixes the cheek pads at each of the first and the second cheek-contact positions which are movable each other. However, the mechanism 50, which fixes the cheek pads at each of the first and second cheek-contact positions which are movable each other, is not limited to the above-mentioned mechanism in which a hook moves in a groove, and it goes without saying that any mechanism, which can fix the cheek pads at each of the first and second cheek-contact positions which are movable each other, may be adopted as the mechanism 50.

Figure 9:
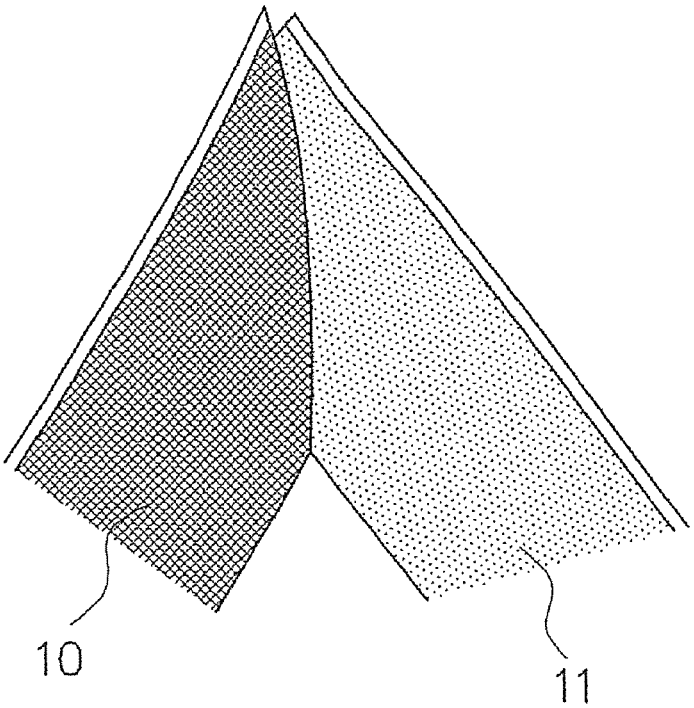
FIG. 9 is a diagram illustrating another specific example of the mechanism which fixes each cheek pads at the first and the second cheek-contact positions, which are movable positions each other, on both sides of the helmet according to this embodiment.

For example, by using detachable hook and pile fastening tape (e.g. Velcro) as illustrated in FIG. 9, it is also possible to fix the cheek pads at each of the first and the second cheek-contact positions which are movable each other. FIG. 9 is a diagram illustrating another specific example of the mechanism that fixes the cheek pads on both sides of the helmet according to this embodiment at each of the first and the second cheek-contact positions which are movable each other. As illustrated in FIG. 9, since a hook-raised surface (female side 10) is pressed against or separated from a close looped-raised surface (male side 11), the female side and the male side are capable of fixing or movable each other.

Further, in the above mentioned embodiment, when a one member serves as a fulcrum and other members move in grooves, the relative position between the first member and the second member is changed. However, it is a matter of course that the mechanism 50, which fixes the cheek pads at each of the first and second cheek-contact positions which are movable each other, is not limited to this specific example. That is, provided that the mechanism can fix the cheek pads at each of the first and second cheek-contact positions which are movable each other, the mechanism may be composed by a single member instead of the plural members, such as the first member 51 and the second member 52.

Furthermore, a positional relationship between the first member 51 and the second member 52 is set in the state illustrated in FIGS. 5 and 6, when the posture of the rider worn the helmet 1 is most upright. Then, if the posture of the rider worn the helmet 1 is tilted forward and lowest, by shifting the first member 51 in the direction of an arrow P of FIG. 5, the members 54 and 55 move along the grooves 540 and 550, respectively. As a result, the positional relationship between the first member 51 and the second members 52 becomes the state illustrated in FIGS. 7 and 8. Accordingly, as the cheek pad 7 is shifted to the lower side of the helmet 1, that is, slid toward the chin from the cheek. Because the center pad 9 mounted on the inside of the helmet 1 is moved relative to the helmet 1 forward from the parietal region of the rider as described below, it is avoided that the cheek pad 7 strongly presses the cheek in the direction of upward from the chin. Then, as the cheek pad 7 supports the cheek, the helmet fits the head of the rider and the field of view on the front upper side can be ensured even though the center pad 9 is shifted forward from the parietal region of the rider by a little distance. This will be described below.

Further, when the rider worn the helmet 1 returns to the most upright posture, by shifting the first member 51 in the direction of an arrow Q of FIG. 7, the members 54 and 55 will be moved in the grooves 540 and 550, respectively. Then, the positional relationship between the first member 51 and the second member 52 returns to the state illustrated in FIGS. 5 and 6.

Figure 10C:
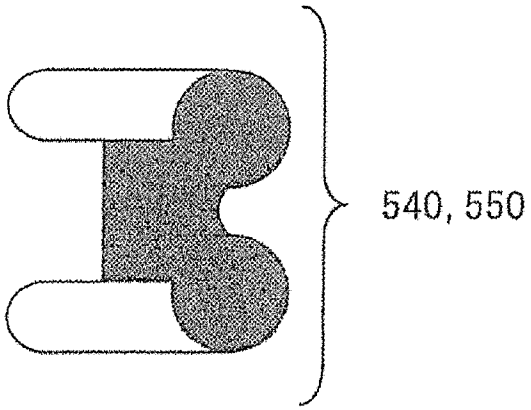
FIGS. 10A, 10B, and 10C are diagrams illustrating other examples of grooves that allow each cheek pads on both sides of the helmet according to this embodiment to shift the positions.
Figure 10B:
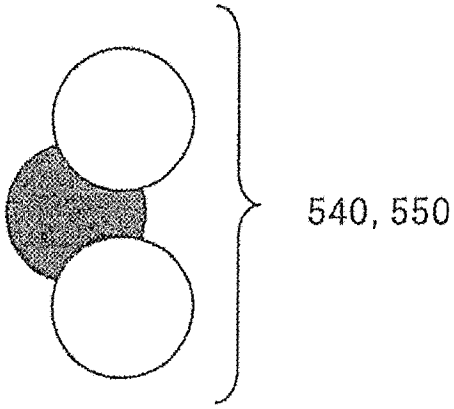
Figure 10A:
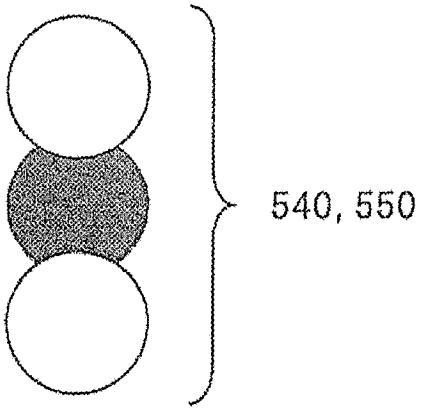

Meanwhile, in the above mentioned embodiment, the shapes of the grooves 540 and 550 are explained as an example in which a plurality of circles are connected successively so that the centers of the members 54 and 55 linearly move along the centers of the grooves 540 and 550. However, the shapes of the grooves 540 and 550 can be adopted the optional shapes as illustrated in FIGS. 10A, 10B, and 10C. FIGS. 10A, 10B, and 10C are diagrams illustrating other examples of grooves to shift the positions of the cheek pads on both sides of the helmet according to this embodiment.

That is, the shape of the groove may be not only a shape in which the centers of a plurality of circles are linearly connected as illustrated in FIG. 10A but also a shape in which the centers of the members 54 and 55 move in a triangular shape along the centers of the plurality of circles as illustrated in FIG. 10B or, a shape in which the centers of the members 54 and 55 move in an inverted U shape as illustrated in FIG. 10C. Of course, the shape of the groove can be adopted the optional shapes except for the shapes illustrated in FIGS. 10A, 10B, and 10C.

Figure 11:
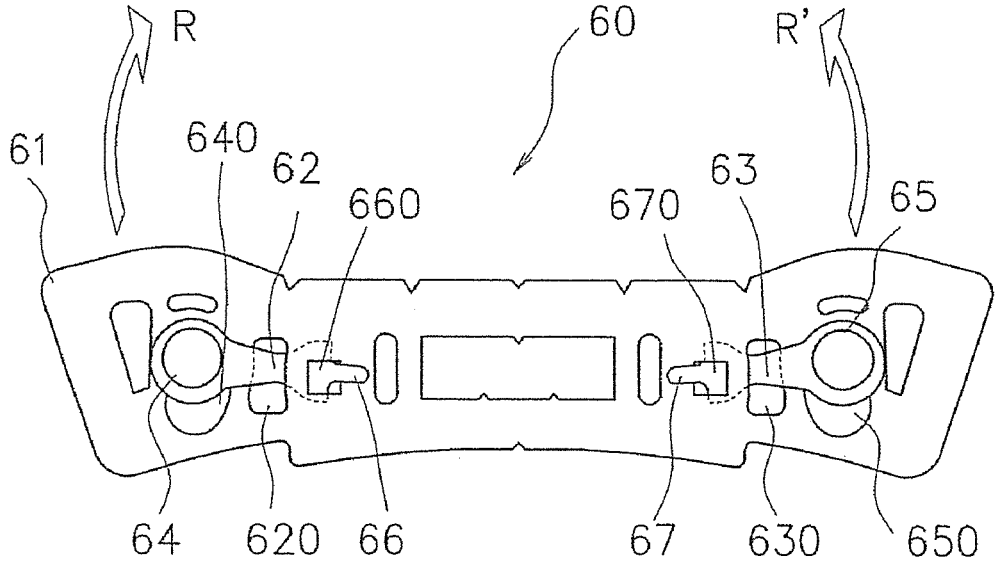
FIG. 11 is a diagram illustrating the state of the neck pad set at the first occipital region-contact position in a mechanism which fixes the neck pad at the first and the second occipital region-contact positions, which are movable positions each other, on the rear portion of the helmet according to this embodiment.
Figure 12:
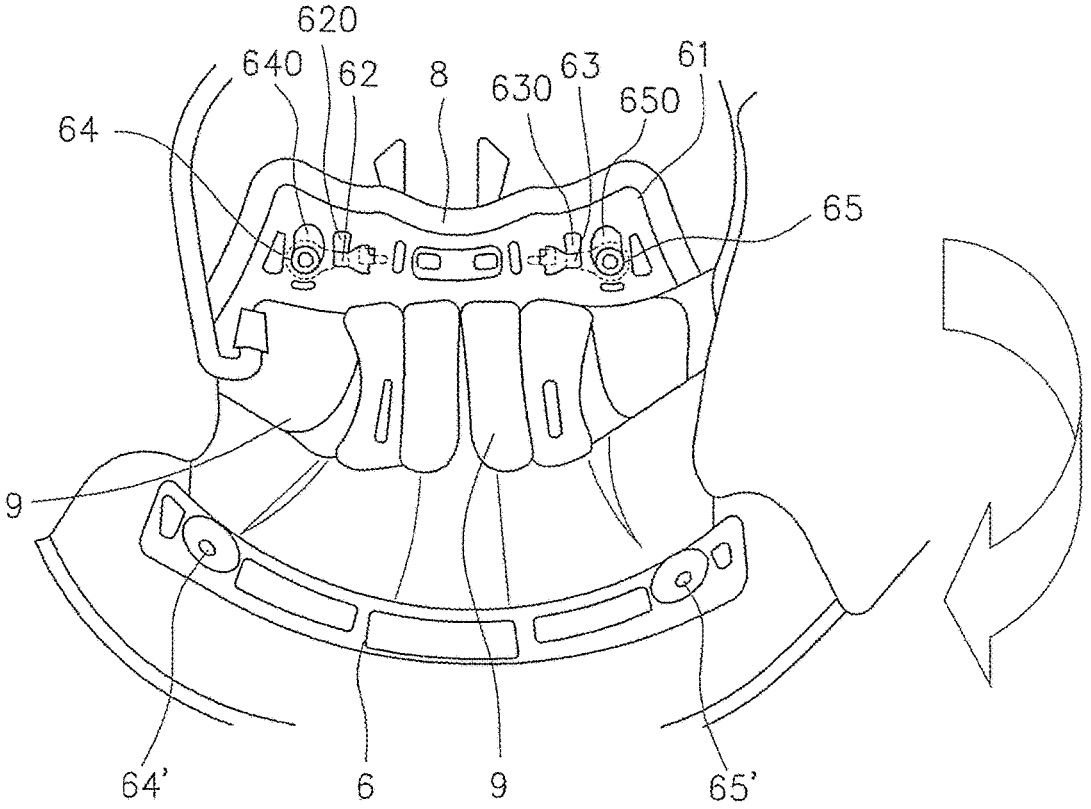
FIG. 12 is a diagram illustrating a state of removing from the helmet the neck pad, which is set at the first occipital region-contact position in the installed mechanism which fixes the neck pad at the first and the second occipital region-contact positions, which are movable positions each other, on the rear portion of the helmet according to this embodiment.

Next, explanations are offered as to a specific example of the mechanism which fixes the neck pad located on a lower end portion of the occipital region in the helmet at each of the first occipital region-contact position and the second occipital region-contact position, respectively. FIG. 11 is a diagram illustrating the state of the neck pad located at the first occipital region-contact position in the mechanism, which fixes the neck pad at the first and the second occipital region-contact positions, which are movable each other, respectively on the rear portion of the helmet according to this embodiment. FIG. 12 is a diagram illustrating a state in which the neck pad located at the first occipital region-contact position is removed from the helmet, and the neck pad is mounted the mechanism, which fixes the neck pad at the first and the second occipital region-contact positions, respectively, which are movable each other.

Figure 13:
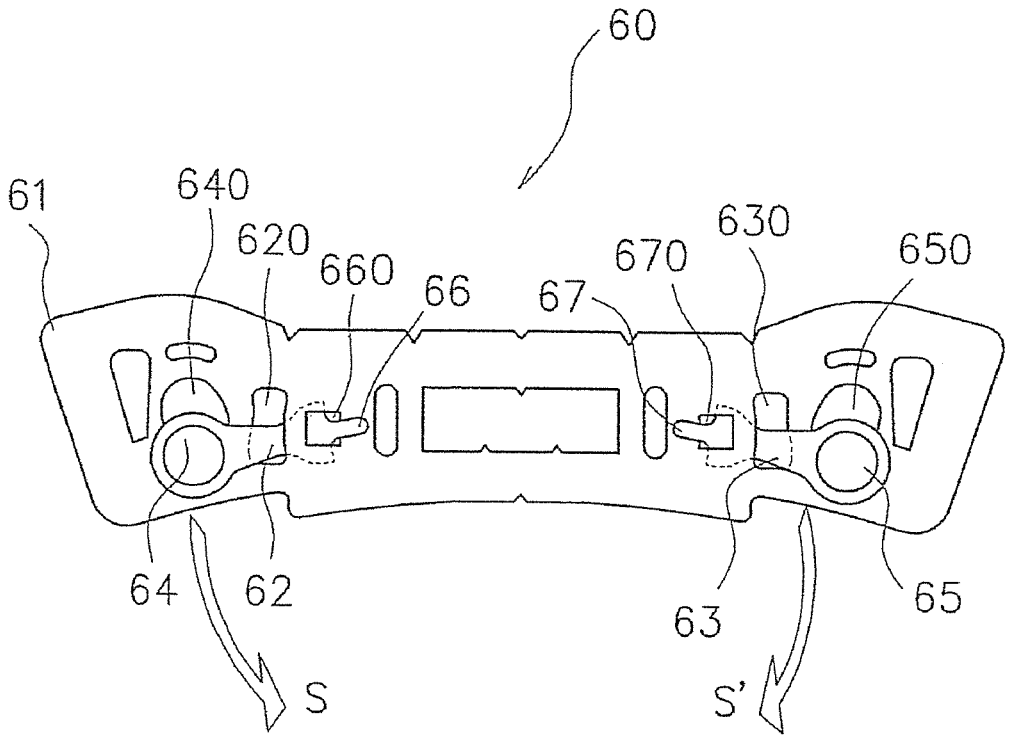
FIG. 13 is a diagram illustrating the state of the neck pad set at the second occipital region-contact position in a mechanism, which fixes the neck pad at the first and the second occipital region-contact positions, which are movable positions each other, on the rear portion of the helmet according to this embodiment.
Figure 14:
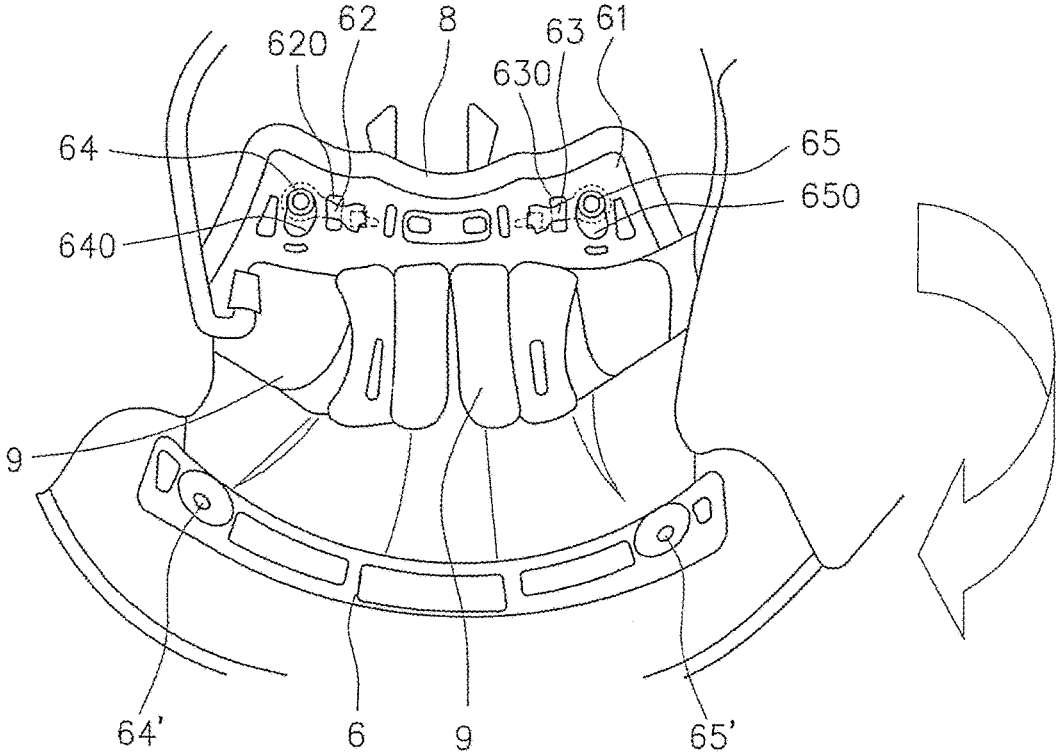
FIG. 14 is a diagram illustrating a state of removing from the helmet the neck pad, which is set at the second occipital region-contact position in the installed mechanism, which fixes the neck pad at the first and the second occipital region-contact positions, which are movable positions each other, on the rear portion of the helmet according to this embodiment.

Further, FIG. 13 is a diagram illustrating the state of the neck pad located at the second occipital region-contact position in the mechanism, which fixes the neck pad at the first and the second occipital region-contact positions, which are movable each other, respectively on the rear portion of the helmet according to this embodiment. FIG. 14 is a diagram illustrating a state in which the neck pad located at the second occipital region-contact position is removed from the helmet, and the neck pad is mounted the mechanism, which fixes the neck pad at the first and the second occipital region-contact positions, which are movable each other, respectively.

As illustrated in FIGS. 11 to 14, the mechanism 60, which fixes the neck pad, located on a lower end portion of the occipital region in the helmet according to this embodiment at each of the first occipital region-contact position and the second occipital region-contact position respectively, which are movable each other, is composed of the first member 61 and the second members 62 and 63 as a specific example thereof and those members are engaged with each other by members 66 and 67. As illustrated in FIGS. 11 and 13, the second members 62 and 63, of which the members 66 and 67 are inserted into holes 660 and 670 formed at the first member 61 and which are engaged with the first member 61 by members 64 and 65, are adapted so that the relative position between the first member 61 and the second members 62 and 63 changes between the first and the second occipital region-contact position which are movable each other, when the member 64 moves in a groove 640 and the member 65 moves in a groove 650 respectively with the members 66 and 67 as fulcrums. Here, as illustrated FIGS. 12 and 14, the first member 61 is integrally joined to the neck pad 8. By mounting the neck pad 8 in a direction of an arrow as illustrated in FIGS. 12 and 14, the neck pad 8 is coupled to the helmet 1 because the member 64 is fixed to a member 64' and the member 65 is fixed to a member 65' respectively through the second members 62 and 63 and the first member 61.

Meanwhile, in the above mentioned embodiment, a mechanism in which a so-called hook moves in a groove is described as a specific example of the mechanism 60 that fixes the neck pad at each of the first and the second occipital region-contact position which are movable each other. However, the mechanism 60, which fixes the neck pad at each of the first and the second occipital region-contact position which are movable each other, is not limited to the above-mentioned mechanism in which a hook moves in a groove, and it goes without saying that any mechanism may be employed as the mechanism 60 if the mechanism can fix the neck pad at each of the first and the second occipital region-contact position which are movable each other.

For example, as illustrated in FIG. 9, by using detachable hook and pile fastening tape (e.g. Velcro), it is also possible to fix the neck pad at each of the first and the second occipital region-contact position which are movable each other. As illustrated in FIG. 9, since a hook-raised surface (female side 10) is pressed against or separated from a close looped-raised surface (male side 11), the female side and the male side are capable of fixing or movable each other.

Further, in the above mentioned embodiment, other members move in grooves with one member as a fulcrum for changing a relative position between the first and the second member. However, of course, the mechanism 60, which fixes the neck pad at each of the first and the second occipital region-contact positions which are movable each other, is also not limited to this specific example. That is, a mechanism composed by a single member can be adopted instead of composed by a plurality of members, such as the first member 61 and second members 62 and 63, if a mechanism can fix the neck pad at each of the first and the second occipital region-contact positions which are movable each other.

Furthermore, when a rider worn the helmet 1 takes the most upright posture, a positional relationship between the first member 61 and the second members 62 and 63 is set in the state illustrated in FIGS. 11 and 12. Then, when the rider worn the helmet 1 tilts forward most, the first member 61 is slid in the directions of arrows R and R' of FIG. 11 so that the members 64 and 65 move in the grooves 640 and 650, respectively. As a result, the positional relationship between the first member 61 and the second members 62 and 63 changes to the state illustrated in FIGS. 13 and 14. Accordingly, since the neck pad 8 is shifted to the upper side of the helmet 1, that is, toward the occipital region from the neck, the center pad 9 integrally joined to the neck pad 8 and mounted on the inside of the helmet 1 is moved forward against the liner 6 from the parietal region of the rider. Moreover, since a material of the neck pad 8, which fills between the occipital region and the neck in the helmet, is soft, the material of the neck pad 8 is crushed when the neck is moved up and applies pressure to the material of the neck pad 8, and then the neck is hardly obstructed within the movable range. Accordingly, the neck pad 8 can come into contact with the neck so as to remain the helmet fitting the head of the rider and ensure the field of view on the front upper side, even though the center pad 9 is shifted forward from the parietal region of the rider by a little distance.

Further, when the rider raises own posture up to most upright, by sliding the first member 61 in the directions of arrows S and S' of FIG. 13 with the members 66 and 67 served as fulcrums, the members 64 and 65 move in the grooves 640 and 650, respectively. As a result, the positional relationship between the first member 61 and the second members 62 and 63 returns to the original state illustrated in FIGS. 11 and 12.

Figure 15B:
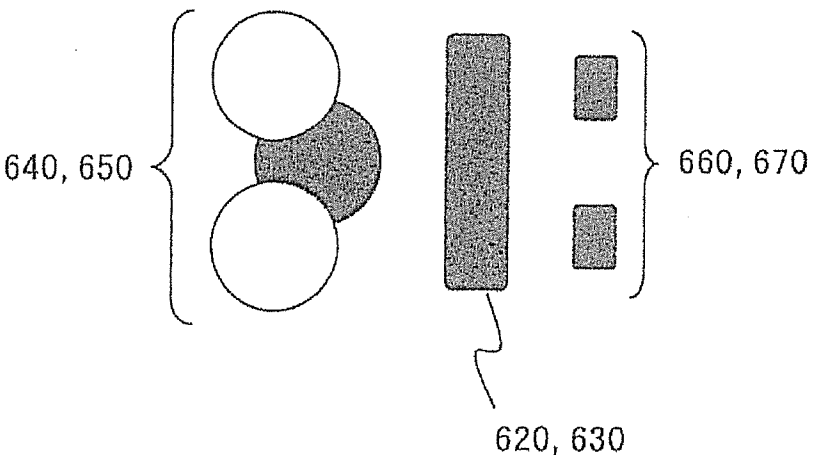
FIGS. 15A and 15B are diagrams illustrating other examples of grooves that allow the neck pad on the rear portion of the helmet according to this embodiment to shift the positions.
Figure 15A:
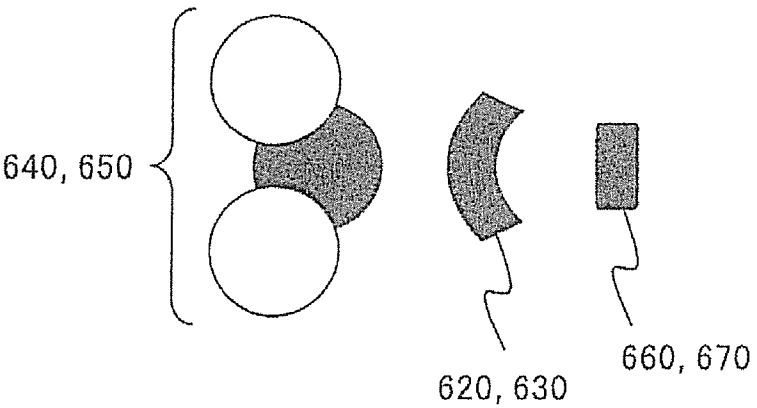

Meanwhile, about the shapes of the grooves 640 and 650, the grooves 620 and 630, and the holes 660 and 670 in the above mentioned embodiment, an example in which the centers of a plurality of circles are connected so that the centers of the members 64 and 65 move in a triangular shape along the centers of the plurality of circles, an example in which the second members 62 and 63 move in substantially rectangular grooves 620 and 630, and an example in which the members 66 and 67 are inserted into single rectangular hole 660 and single rectangular hole 670, respectively, have been described. However, optional shapes can be composed as the shapes of the grooves 640 and 650, the grooves 620 and 630, and the holes 660 and 670 such as illustrated in FIGS. 15A and 15B. FIGS. 15A and 15B are diagrams illustrating other examples of the grooves for moving the position of the neck pad on the rear portion of the helmet according to this embodiment.

That is, the shape of the groove may be not only a shape in which the second members 62 and 63 move in the substantially V-shaped grooves 620 and 630 as illustrated in FIG. 15A but also a shape in which the second members 62 and 63 move in the substantially rectangular grooves 620 and 630 as illustrated in FIG. 15B or a shape in which the members 66 and 67 are inserted into either rectangular holes 660 or 670. It goes without saying that optional shapes can be composed other than the shapes illustrated in FIGS. 15A and 15B.

Next, it will be described that the rider's head, the mechanism which fixes the cheek pads at each of the first and the second cheek-contact positions which are movable each other, the mechanism that fixes the neck pad at each of the first and the second occipital region-contact positions which are movable each other, and the interior state of the helmet in case that the posture of a rider is most upright as well as is tilted forward and lowest when a rider wears the helmet according to the embodiment.

Figure 16:
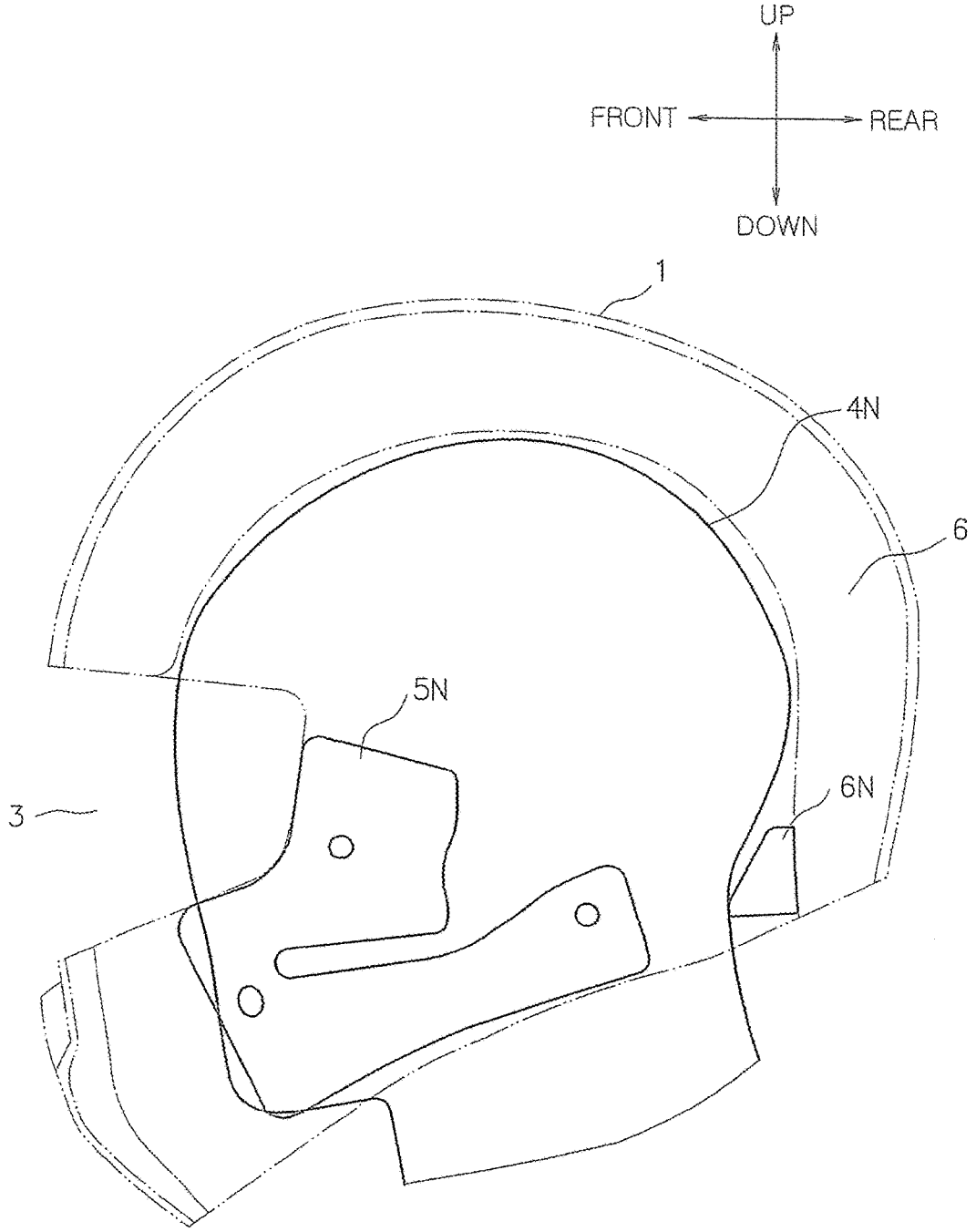
FIG. 16 is a schematic diagram illustrating, when the posture of a rider is most upright, the state of the mechanism that fixes each cheek pads so as to place it at the first cheek-contact position on both sides, and the mechanism that fixes the neck pad so as to place it at the first occipital region-contact position on the rear portion of the helmet according to this embodiment.
Figure 17:
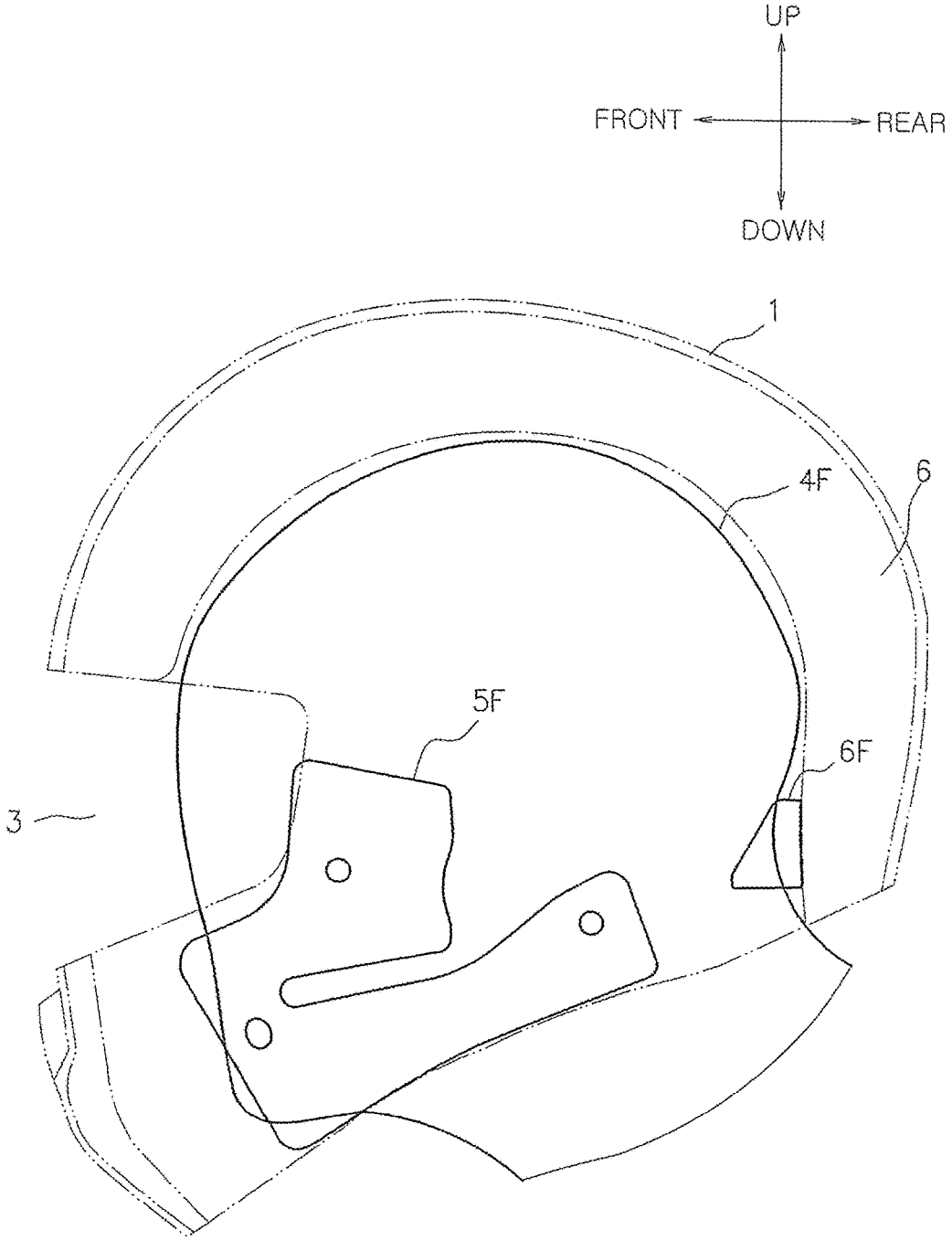
FIG. 17 is a schematic diagram illustrating, when the posture of a rider is tilted forward and lowest, the state of the mechanism that fixes each cheek pads so as to place it at the second cheek-contact position on both sides, and the mechanism that fixes the neck pad so as to place it at the second occipital region-contact position on the rear portion of the helmet according to this embodiment.

FIG. 16 is a schematic view illustrating the state of the mechanism that fixes the cheek pads at the first cheek-contact position on both sides inside of the helmet according to this embodiment, and the state of the mechanism that fixes the neck pad at the first occipital region-contact position on the rear portion of the helmet, when the posture of a rider is most upright. FIG. 17 is a schematic view illustrating the state of the mechanism that fixes the cheek pads at the second cheek-contact position on both sides inside of the helmet according to this embodiment, and the state of the mechanism that fixes the neck pad at the second occipital region-contact position on the rear portion of the helmet, when the posture of a rider is tilted forward and lowest.

First, as illustrated in FIG. 16, when the posture of the rider is most upright, the mechanism 60, which fixes the neck pad at each of the first and the second occipital region-contact positions which are movable each other, fixes the neck pad 8 at the first occipital region-contact position 6N coming into contact with the occipital region of the rider's head 4N. Further, at this time, the mechanism 50, which fixes the cheek pads at each of the first and the second cheek-contact positions which are movable each other, fixes the cheek pad 7 at the first cheek-contact position 5N coming into contact with the rider's cheek.

Accordingly, the rider head 4N comes into close contact with the center pad 9 among the interior pads of the helmet 1, the occipital region of the rider comes into close contact with the neck pad 8 fixed at the first occipital region-contact position 6N, and the rider's cheek comes into close contact with the cheek pad 7 fixed at the first cheek-contact position 5N. As a result, the helmet 1 fits snugly the rider's head 4N. At this moment, the mechanism 60, which fixes the neck pad at each of the first and the second occipital region-contact positions which are movable each other, is in the above-mentioned state illustrated in FIGS. 11 and 12. And the mechanism 50, which fixes the cheek pads at each of the first and the second cheek-contact positions which are movable each other, is in the above-mentioned state illustrated in FIGS. 5 and 6.

Next, as illustrated in FIG. 17, when the posture of a rider is tilted forward and lowest, the mechanism 60, which fixes the neck pad at each of the first and the second occipital region-contact positions which are movable each other, moves the neck pad 8 in contact with the occipital region of the rider's head 4F to the second occipital region-contact position 6F from the first occipital region-contact position 6N and then fixes the neck pad 8. Further, at this moment, the mechanism 50, which fixes the cheek pads at each of the first and the second cheek-contact positions which are movable each other, moves the cheek pad 7 in contact with the rider's cheek to the second cheek-contact position 5F from the first cheek-contact position 5N coming into contact with the cheek of the rider and then fixes the cheek pad 7.

Accordingly, the rider's head 4F comes into close contact with the center pad 9 among the interior pads of the helmet 1, the occipital region of the rider comes into close contact with the neck pad 8 fixed at the second occipital region-contact position 6F, and the rider's cheek comes into close contact with the cheek pad 7 fixed at the second cheek-contact position 5F. As a result, the helmet 1 fits snugly the rider's head 4F. At this moment, the mechanism 60, which fixes the neck pad at each of the first and the second occipital region-contact positions which are movable each other, is in the above-mentioned state illustrated in FIGS. 13 and 14, and the mechanism 50, which fixes the cheek pads at each of the first and the second cheek-contact positions which are movable each other, is in the above-mentioned state illustrated in FIGS. 7 and 8.

Meanwhile, when the posture of the rider is tilted forward and lowest, since the mechanism 60, which fixes the neck pad at each of the first and the second occipital region-contact positions which are movable each other, moves the neck pad 8 in contact with the occipital region of the rider's head 4N to the second occipital region-contact position 6F from the first occipital region-contact position 6N and then fixes the neck pad 8, the mechanism 50, which fixes the cheek pads at each of the first and the second cheek-contact positions which are movable each other, moves the cheek pad 7 in contact with the rider's cheek to the second cheek-contact position 5F from the first cheek-contact position 5N and fixes the cheek pad 7 in order to avoid the strong contact between the cheek pad 7 and the rider's cheek if the cheek pad 7 does not move from the first cheek-contact position 5N.

Consequently, since the center pad 9 among the interior pads moves from an original fixation position by a little distance doe to the change from a normal ride state, in which the neck pad 8 is fixed at the first occipital region-contact position 6N in contact with the occipital region of the rider's head 4N and the cheek pad 7 is fixed at the first cheek-contact position 5N in contact with the rider's cheek, into a forward tilting ride state, in which the neck pad 8 is moved to and then fixed at the second occipital region-contact position 6F in contact with the occipital region of the rider's head 4F and the cheek pad 7 is moved to and then fixed at the second cheek-contact position 5F in contact with the rider's cheek, accordingly, the helmet 1 shifts relatively to the center pad 9 toward the occipital region. In other words, the rotation of the helmet 1 toward the occipital region from the frontal region of the rider' head in the side view of the rider remains the helmet fitting the rider's head and ensures the front upper sight of the rider on a forward tilting ride state.

In addition, as illustrated in FIGS. 16 and 17, since the interior pads is mounted inside of the helmet 1 so as to come into contact with rider's head 4N and 4F respectively, the center pad 9 may be attached to the liner 6 that is fitted into the inside of the helmet 1. Further, as previously mentioned, the shape of the center pad 9 is composed the optional shapes and structures, such as a large pad covering the portion of a rider's head between the forehead and an upper portion of the neck via the parietal region, a small pad covering only the occipital region of a rider's head, and one divisible pad into each parts for covering the frontal region, the parietal region, the left and right temporal regions, and the occipital region, respectively. That is, any pad can be called "the center pad", if only the pad is joined to the neck pad 8, even though it has any shape and structure. Accordingly, as long as the neck pad 8 moves to the second occipital region-contact position 6F in contact with the occipital region from the first occipital region-contact position 6N in contact with the occipital region, the center pad 9 moves from the normal fixation position by a little distance, even though the center pad 9 joined to the neck pad 8 has any shape and structure. Therefore, the helmet 1 moves relative to the center pad 9 toward the occipital region. Meanwhile, in this embodiment, a specific example is described as that the neck pad 8 in contact with the occipital region moves to the second occipital region-contact position 6F from the first occipital region-contact position 6N. However, as long as the above mentioned advantage of this embodiment is obtained by the movement of the center pad 9, it goes without saying that various methods and aspects, such as a method of moving the neck pad stepwise, can be thought of as a method of moving the neck pad 8.

Figure 18:
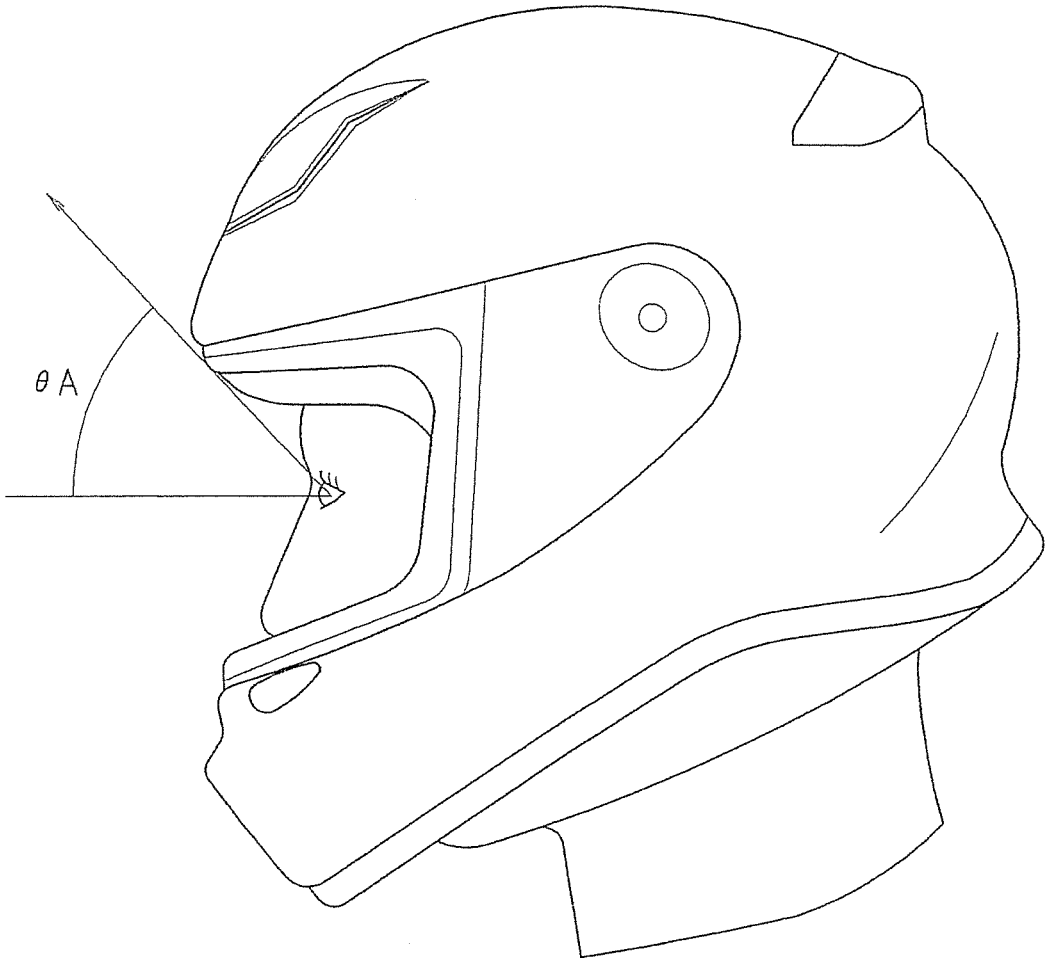
FIG. 18 is a diagram illustrating a front elevation angle of a rider who wears the helmet according to this embodiment of which the neck pad is fixed at the first occipital region-contact position and each cheek pads is fixed at the first cheek-contact position.
Figure 19:
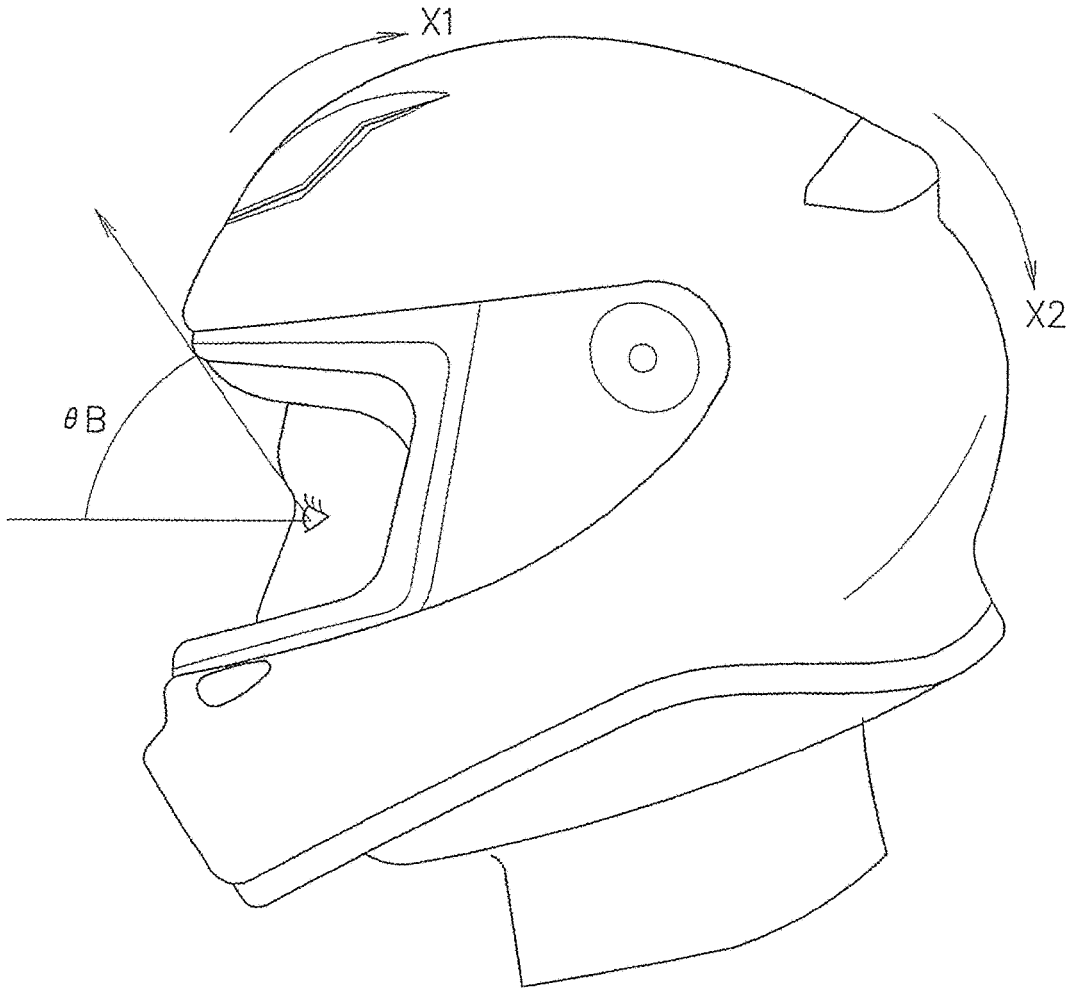
FIG. 19 is a diagram illustrating a front elevation angle of a rider who wears the helmet according to this embodiment of which the neck pad is fixed at the second occipital region-contact position and each cheek pads is fixed at the second cheek-contact position.

Next, when the normal ride state is shifted to the forward tilting ride state, how much the elevation angle of a rider's frontal sight changes will be described. FIG. 18 is a diagram illustrating the elevation angle of a rider's frontal sight when the rider wears the helmet according to this embodiment of which the neck pad is fixed at the first occipital region-contact position and the cheek pads are fixed at the first cheek-contact position. FIG. 19 is a diagram illustrating the elevation angle of a rider's frontal sight when the rider wears the helmet according to this embodiment of which the neck pad is fixed at the second occipital region-contact position and the cheek pads are fixed at the second cheek-contact position.

Figure 23:
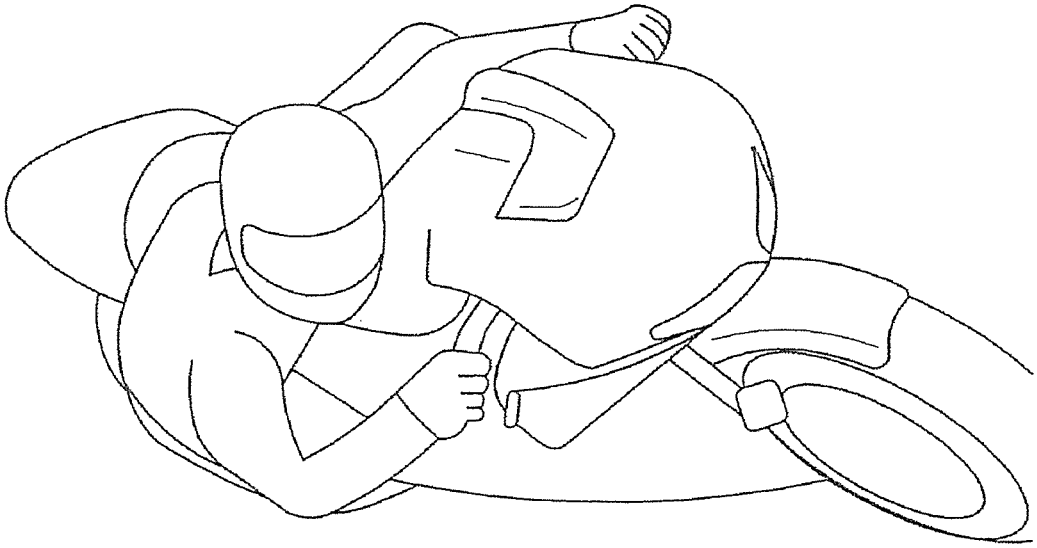
FIG. 23 is a diagram illustrating a state in which a rider must extremely look up and watch forward to try to obtain information about the next course when he tilts significantly his riding posture and takes a low posture for cornering and passing through a sharp curve.

As shown obviously in FIGS. 18 and 19, it is seen that the elevation angle θB of a rider in the forward tilting ride state is larger than the elevation angle θA in the normal ride state. In this way, the center pad 9, among the interior pads shifts by a little distance and, as a result, the liner 6 shifts relative to the center pad 9 toward the occipital region (in the direction of arrows X1 and X2). In other words, in the side view of the rider, since the helmet 1 is rotated toward the occipital region from the frontal region on the rider's head, the rider can ensure properly the frontal upper sight on the front window 3 without extremely looking upward. Meanwhile, as a result of a verification test subject to the motorsports riders, they could obtain the sufficient information through the frontal upper sight after the liner 6 rotated four degrees toward the occipital region from the frontal region on the rider's head, even if the rider takes the posture illustrated in FIG. 23.

Next, the comparison of the helmet according to the embodiment of this invention with the conventional helmet in view of the safety will be described. Specifically, in the embodiment helmet of this invention, the liner 6 is rotated four degrees rearward in order to ensure the front upper sight of the rider in the forward tilting ride state. We confirmed whether the shift of the liner 6 affected the impact absorption performance and the roll off resistance of the helmet by the two requirements, the impact absorption test and the stability (roll off) test of JIS T 8133:2007, the motorcycle helmet standard (hereinafter, referred to as JIS standard), the shock absorption test and the roll-off test and the test results thereof were compared with each other.

Test methods will be described. First, the impact absorption test was conducted according to JIS standard. However, the impact test points were rotated four degrees rearward at all of the frontal region, the parietal region, and the occipital region on the helmet according to the embodiment of this invention, while the other test conditions were the same as those of the conventional helmet.

Figure 20A:
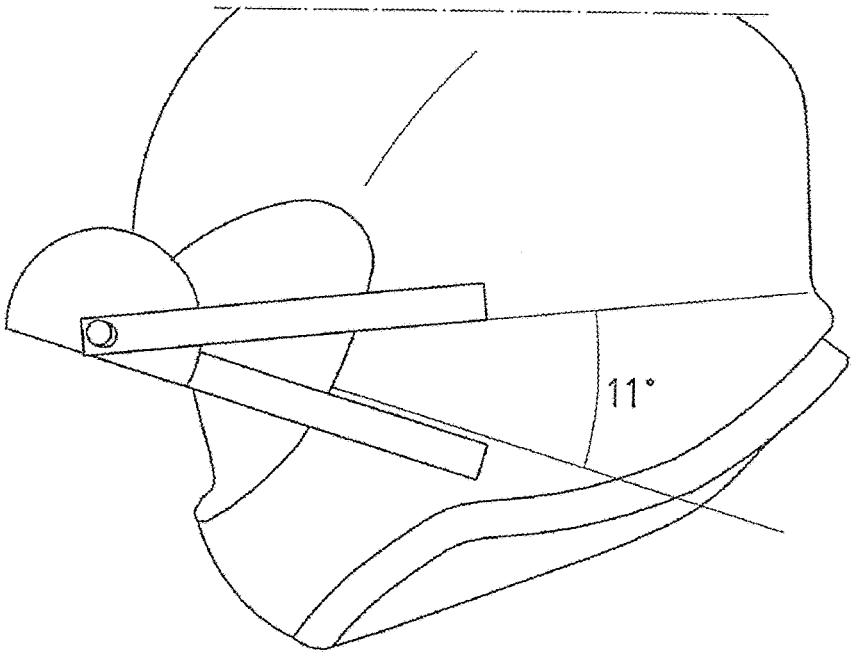
FIG. 20A is a diagram illustrating the result of a roll-off test of the helmet according to the embodiment of the invention and FIG. 20B is a diagram illustrating the result of a roll-off test of a conventional helmet.
Figure 20B:
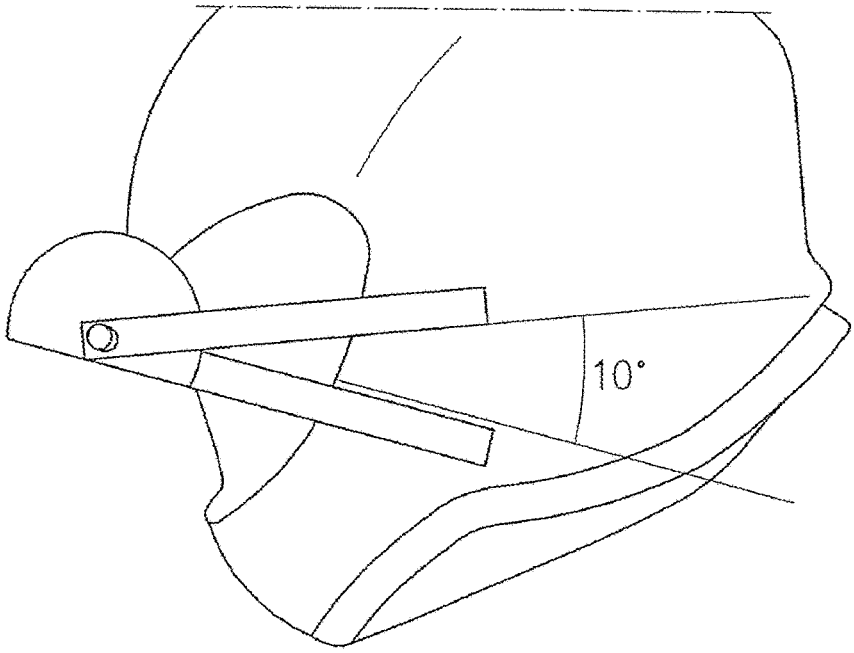

Next, the roll-off test was also conducted according to JIS standard. However, since JIS standard specifies only that a helmet should not be taken off by the roll-off test, all of the helmets which do not take off are determined to be passed. So, we measured the rotational angle by comparing the angle of the reference plane after test with one before test, which is specified in the requirements of ECE standard while JIS standard does not specify, in order to compare easily with a numeric data between the helmet according to the embodiment of this invention and the conventional helmet. The result of the stability (roll-off) test of the helmet according to the embodiment of this invention is illustrated in FIG. 20A, and the result of the roll-off test of the conventional helmet is illustrated in FIG. 20B.

Figure 21:
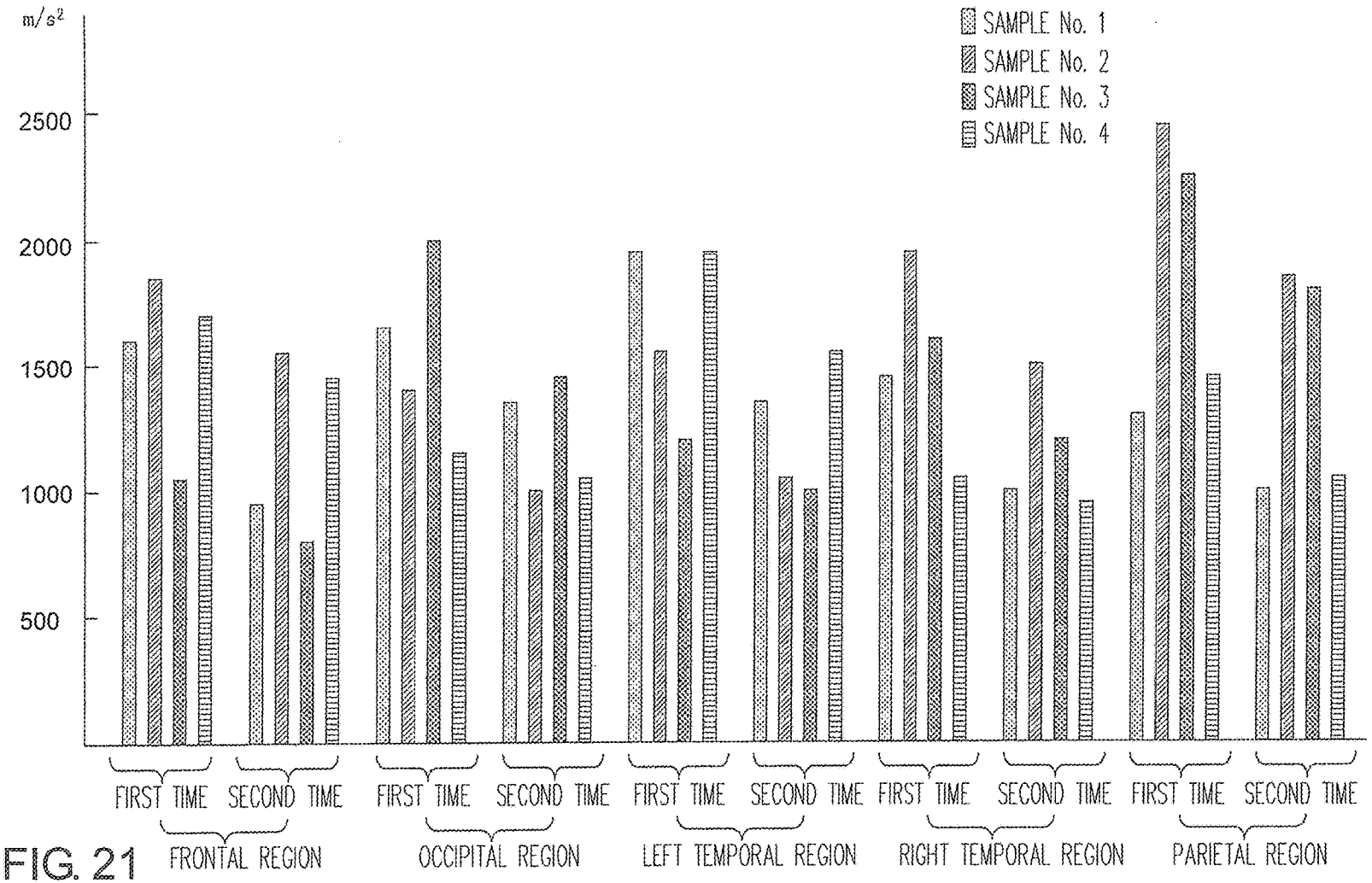
FIG. 21 is a diagram illustrating the results of a shock absorption test of the helmet according to the embodiment of the invention.
Figure 22:
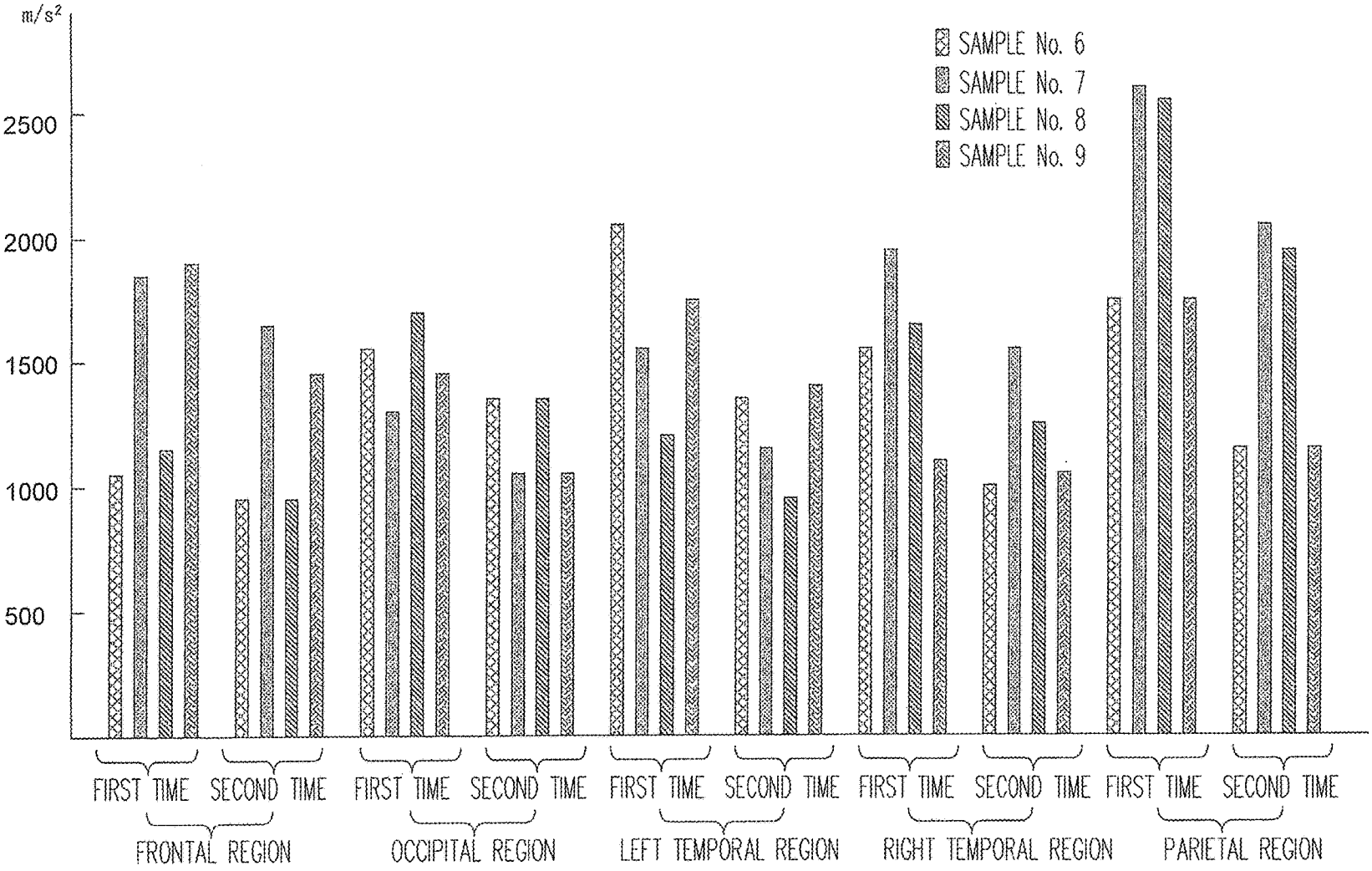
FIG. 22 is a diagram illustrating the results of a shock absorption test of the helmet in the related art.

Next, the test results of the helmet according to the embodiment of this invention and the conventional helmet will be examined. First, the results of the shock absorption test will be considered. FIG. 21 is a diagram illustrating the results of the shock absorption test of the helmet according to the embodiment of this invention. FIG. 22 is a diagram illustrating the results of the shock absorption test of the conventional helmet. There is about 50G deference at the frontal region, if the impact force is converted into the gravitational acceleration G, between the sample No. 1 of the helmet according to the embodiment of this invention illustrated in FIG. 21 and the sample No. 6 of the conventional helmet illustrated in FIG. 22; that is, the former helmet recorded slightly higher G value than the later helmet. However, on the other conditions and at the same test points, there is no significant difference between both helmets; and consequently, all the samples of the helmet according to the embodiment of this invention, including the case that the impact points were out of the region specified in JIS standard, comply with the requirement of JIS standard.

Next, considering the comparison of the roll-off test results, there was only about one degree difference in the rotation angle and there was no specifically mentioned point or negative factor causing an obstacle to safety in the other aspects. From the above two points, we come to the conclusion that the safety performance of the helmet is not affected at all even though the rider wears helmet according to the embodiment of this invention.

Meanwhile, the motorcycle helmet, which is a typical component, has been described in the above mentioned embodiment, but this invention can also be applied to the other components except the motorcycle helmet.

As described above, this invention is to shift the position of the helmet by changing the positions of the neck pad in contact with the rider's neck of a rider as well as the cheek pads in contact with the rider's cheeks. That is, since the center pad joined to the neck pad is moved by moving the neck pad, as a result, the position of the helmet is moved. In this way, according to this invention, it is possible to obtain the helmet that fits the rider's head and allows the field of view on the front upper side of the helmet to be easily ensured even though the rider extremely leans forward.

This invention has been explained as above by using the preferred embodiments. Herein, this invention has been explained by using the specific examples, but these specific examples can be altered and modified in various ways without departing from the wide purpose and scope of this invention that is defined by the patent claims.

What is claimed is:

1. A helmet comprising:

a first pad in contact with an occipital region of a rider; and a second pad in contact with the rider's cheeks, wherein the first pad is movably provided so as to move at least from a first occipital region-contact position to a second occipital region-contact position in contact with the occipital region at each position by using a first connection mechanism with a hook moving in a groove or with detachable hook and pile fastening tape, the second pad is movably provided so as to move from a first cheek-contact position to a second cheek-contact position in contact with the cheek at each position when the first pad moves from the first occipital region-contact position to the second occipital region-contact position by using a second connection mechanism with a hook moving in a groove or with detachable hook and pile fastening tape, and the helmet is characterized to move relative to the rider's head by a predetermined distance when a first state, in which the first pad is located at the first occipital region-contact position and the second pad is located at the first cheek-contact position, is changed into a second state in which the first pad moves to the second occipital region-contact position and the second pad moves to the second cheek-contact position.

2. The helmet according to claim 1, wherein the movement of the helmet by the predetermined distance is the rotation of the helmet toward the occipital region from a frontal region of the rider in a side view of the rider.

3. The helmet according to claim 1, wherein a front elevation angle of the rider in the second state is larger than one in the first state.

4. The helmet according to claim 2, wherein a front elevation angle of the rider in the second state is larger than one in the first state.

5. The helmet according to claim 1, wherein the first pad is joined to a center pad mounted on the interior liner that is fitted to the inside of the helmet.

6. The helmet according to claim 2, wherein the first pad is joined to a center pad mounted on the interior liner that is fitted to the inside of the helmet.

7. The helmet according to claim 3, wherein the first pad is joined to a center pad mounted on the interior liner that is fitted to the inside of the helmet.

8. The helmet according to claim 4, wherein the first pad is joined to a center pad mounted on the interior liner that is fitted to the inside of the helmet.

9. The helmet according to claim 1, further comprising:

the first pad fixing mechanism that fixes the first pad to the inside of the helmet at each of the first and the second occipital region-contact positions; and the second pad fixing mechanism that fixes the second pad to the inside of the helmet at each of the first and the second cheek-contact positions.

10. The helmet according to claim 2, further comprising:

the first pad fixing mechanism that fixes the first pad to the inside of the helmet at each of the first and the second occipital region-contact positions; and the second pad fixing mechanism that fixes the second pad to the inside of the helmet at each of the first and the second cheek-contact positions.

11. The helmet according to claim 3, further comprising:

the first pad fixing mechanism that fixes the first pad to the inside of the helmet at each of the first and the second occipital region-contact positions; and the second pad fixing mechanism that fixes the second pad to the inside of the helmet at each of the first and the second cheek-contact positions.

12. The helmet according to claim 4, further comprising:

the first pad fixing mechanism that fixes the first pad to the inside of the helmet at each of the first and the second occipital region-contact positions; and the second pad fixing mechanism that fixes the second pad to the inside of the helmet at each of the first and the second cheek-contact positions.

13. The helmet according to claim 5, further comprising:

the first pad fixing mechanism that fixes the first pad to the inside of the helmet at each of the first and the second occipital region-contact positions; and the second pad fixing mechanism that fixes the second pad to the inside of the helmet at each of the first and the second cheek-contact positions.

14. The helmet according to claim 6, further comprising:

the first pad fixing mechanism that fixes the first pad to the inside of the helmet at each of the first and the second occipital region-contact positions; and the second pad fixing mechanism that fixes the second pad to the inside of the helmet at each of the first and the second cheek-contact positions.

15. The helmet according to claim 7, further comprising:

the first pad fixing mechanism that fixes the first pad to the inside of the helmet at each of the first and the second occipital region-contact positions; and the second pad fixing mechanism that fixes the second pad to the inside of the helmet at each of the first and the second cheek-contact positions.

16. The helmet according to claim 8, further comprising:

the first pad fixing mechanism that fixes the first pad to the inside of the helmet at each of the first and the second occipital region-contact positions; and the second pad fixing mechanism that fixes the second pad to the inside of the helmet at each of the first and the second cheek-contact positions.

17. A helmet comprising:

a first pad in contact with an occipital region of a rider; and a second pad in contact with the rider's cheeks, wherein the first pad is integrally joined to a first occipital coupling member comprising an occipital hook, the occipital hook is movably connected to an occipital groove formed in a second occipital coupling member, and the second occipital coupling member is connected to the helmet, so that the first pad moves from a first occipital region-contact position in which the occipital hook is located at one end of the occipital groove, to a second occipital region-contact position in which the occipital hook is located at the other end of the occipital groove, in contact with the occipital region at each position, the second pad is integrally joined to a first cheek coupling member comprising a cheek hook, the cheek hook is movably connected to a cheek groove formed in a second cheek coupling member, and the second occipital coupling member is connected to the helmet, so that the second pad moves from a first cheek-contact position in which the cheek hook is located at one end of the cheek groove, to a second cheek-contact position in which the cheek hook is located at the other end of the cheek groove, in contact with the cheeks at each position, and the helmet is characterized to move relative to the rider's head by a predetermined distance when a first state, in which the first pad is located at the first occipital region-contact position and the second pad is located at the first cheek-contact position, is changed into a second state in which the first pad moves to the second occipital region-contact position and the second pad moves to the second cheek-contact position.

* * * * *